US009336705B2

(12) United States Patent
Inoue et al.

(10) Patent No.: US 9,336,705 B2
(45) Date of Patent: May 10, 2016

(54) SELF-LUMINOUS DISPLAY DEVICE, CONTROL METHOD OF SELF-LUMINOUS DISPLAY DEVICE, AND COMPUTER PROGRAM

(71) Applicant: Sony Corporation, Tokyo (JP)

(72) Inventors: Yasuo Inoue, Tokyo (JP); Yohei Funatsu, Kanagawa (JP); Hidehisa Shimizu, Kanagawa (JP); Takashi Uchida, Kanagawa (JP)

(73) Assignee: Joled Inc., Tokyo (JP)

( * ) Notice: Subject to any disclaimer, the term of this patent is extended or adjusted under 35 U.S.C. 154(b) by 189 days.

(21) Appl. No.: 14/135,032

(22) Filed: Dec. 19, 2013

(65) Prior Publication Data

US 2014/0176623 A1 Jun. 26, 2014

(30) Foreign Application Priority Data

Dec. 26, 2012 (JP) ..... 2012-283321

(51) Int. Cl.
*G09G 3/32* (2006.01)
*G09G 3/20* (2006.01)

(52) U.S. Cl.
CPC ..... *G09G 3/3208* (2013.01); *G09G 3/2003* (2013.01); *G09G 2320/029* (2013.01); *G09G 2320/0285* (2013.01); *G09G 2320/046* (2013.01); *G09G 2330/04* (2013.01); *G09G 2340/06* (2013.01); *G09G 2360/16* (2013.01)

(58) Field of Classification Search
CPC ..... G09G 3/3208; G09G 3/2003; G09G 2320/0285; G09G 2360/16; G09G 2340/06; G09G 2330/04; G09G 2320/029; G09G 2320/046; G09G 2320/02; G09G 2320/0233; G09G 2320/0295; G09G 2320/04; G09G 2320/043; G09G 2320/062; G09G 2320/0626
See application file for complete search history.

(56) References Cited

U.S. PATENT DOCUMENTS

| | | | | |
|---|---|---|---|---|
| 2006/0164348 | A1* | 7/2006 | Ozawa et al. | 345/76 |
| 2007/0236431 | A1* | 10/2007 | Tada et al. | 345/84 |
| 2009/0147032 | A1* | 6/2009 | Kim | 345/690 |
| 2010/0165009 | A1* | 7/2010 | Mori et al. | 345/690 |
| 2011/0141149 | A1* | 6/2011 | Inoue et al. | 345/690 |
| 2011/0216084 | A1* | 9/2011 | Mori et al. | 345/589 |
| 2012/0306947 | A1* | 12/2012 | Kim et al. | 345/694 |

FOREIGN PATENT DOCUMENTS

WO 2008-149842 A1 12/2008

* cited by examiner

*Primary Examiner* — Ariel Balaoing
*Assistant Examiner* — Ivelisse Martinez Quiles
(74) *Attorney, Agent, or Firm* — Sheridan Ross P.C.

(57) ABSTRACT

Provided is a self-luminous display device including a data calculation section configured to calculate, by using a supplied video signal, data relating to a luminance amount accumulated in a unit of a first block in a target region for luminance control in a screen on which a plurality of pixels are arranged in a matrix, each of the pixels including a light emitting element which emits light by itself according to a current amount, a resampling section configured to resample the data relating to the luminance amount in the target region, in a unit of a second block, the data relating to the luminance amount being calculated by the data calculation section, the second block being larger than the first block, and a scaling section configured to generate data for luminance control in the target region by scaling the data resampled by the resampling section.

20 Claims, 20 Drawing Sheets

SELF-LUMINOUS DISPLAY DEVICE, CONTROL METHOD OF SELF-LUMINOUS DISPLAY DEVICE, AND COMPUTER PROGRAM

CROSS REFERENCE TO RELATED APPLICATIONS

This application claims the benefit of Japanese Priority Patent Application JP 2012-283321 filed Dec. 26, 2012, the entire contents of which are incorporated herein by reference.

BACKGROUND

The present disclosure relates to a self-luminous display device, a control method of a self-luminous display device, and a computer program.

Liquid crystal display devices using liquid crystals and plasma display devices using plasma have been implemented as thin display devices with a flat plane.

A liquid crystal display device is a display device including a backlight which displays images by changing an arrangement of liquid crystal molecules by the application of a voltage, and by allowing light to pass from the backlight and shielding the light. Further, a plasma display device is a display device which displays images by having a plasma state by applying a voltage to a gas enclosed within a substrate, and by making ultraviolet light, which is generated by energy occurring at the time when returning to an original state from the plasma state, visible light by irradiating on a fluorescent body.

On the other hand, development has been progressing in recent years for self-luminous type display devices using organic EL (electro luminescence) elements which emit light by the elements themselves when a voltage is applied. An organic EL element changes from a ground state to an excited state when energy is received by electrodes, and discharges the energy of a difference when returning from the excited state to the ground state. An organic EL display device is a display device which displays images by using the light discharged by these organic EL elements.

A self-luminous type display device is different to a liquid crystal display device in which a backlight is necessary, and since is it not necessary to have a backlight in order for elements to emit light by themselves, a self-luminous type display device is capable of having a thin configuration when compared to that of a liquid crystal display device. Further, since moving image characteristics, viewing angle characteristics, color reproductively and the like are superior when compared to those of a liquid crystal display device, self-luminous type display devices using organic EL elements have been receiving attention as next generation thin display devices with a flat plane.

However, in organic EL elements, the luminance characteristics will deteriorate when a voltage is continuously applied, and the luminance will decrease even if the same current is input. As a result of this, in the case where the luminance frequency of specific pixels is high, a phenomenon of so-called "image persistence" unfortunately occurs in these specific pixels, since the luminance characteristics are deteriorated when compared to the luminance characteristics of the other pixels.

This image persistence phenomenon also occurs in liquid crystal display devices and plasma display devices, and since these display devices perform image display by applying an alternating voltage, a mechanism which adjusts the applied voltage may be necessary. In contrast to this, a method has been adopted in self-luminous type display devices, which prevents image persistence by controlling the current amount. For example, JP 2008-149842A discloses prevention technology of image persistence in a self-luminous type display device.

SUMMARY

JP 2008-149842A discloses technology, in a display device including light emitting elements which emit light in accordance with a current amount, such as an organic EL display device, which suppresses an image persistence phenomenon of the screen by calculating a luminance amount from a video signal and controlling the video signal. While the technology disclosed in JP 2008-149842A controls the luminance of the entire screen for suppressing an image persistence phenomenon of the screen, more flexible luminance control is sought after for suppressing an image persistence phenomenon.

Accordingly, the present disclosure provides a new and improved self-luminous display device capable of suppressing an image persistence phenomenon of a screen by calculating a luminance amount from a video signal and flexibly controlling the video signal.

According to an embodiment of the present disclosure, there is provided a self-luminous display device including a data calculation section configured to calculate, by using a supplied video signal, data relating to a luminance amount accumulated in a unit of a first block in a target region for luminance control in a screen on which a plurality of pixels are arranged in a matrix, each of the pixels including a light emitting element which emits light by itself in accordance with a current amount, a resampling section configured to resample the data relating to the luminance amount in the target region, in a unit of a second block, the data relating to the luminance amount being calculated by the data calculation section, the second block being larger than the first block, and a scaling section configured to generate data for luminance control in the target region by scaling the data resampled by the resampling section in the unit of first block.

According to an embodiment of the present disclosure, there is provided a self-luminous display device including a data calculation section configured to calculate data relating to a luminance amount accumulated in a unit of a first block in a target region for luminance control in a screen on which a plurality of pixels are arranged in a matrix and an image is displayed with a red pixel, a green pixel, a blue pixel, and a white pixel, each of the pixels including a light emitting element which emits light by itself in accordance with a current amount, and a signal processing section configured to execute signal processing on a video signal supplied to the screen based on a peak of the data relating to the luminance amount calculated by the data calculation section.

According to an embodiment of the present disclosure such as described above, a new and improved self-luminous display device can be provided capable of suppressing an image persistence phenomenon of a screen by calculating a luminance amount from a video signal and flexibly controlling the video signal.

DETAILED DESCRIPTION OF THE EMBODIMENT(S)

Figure 1:
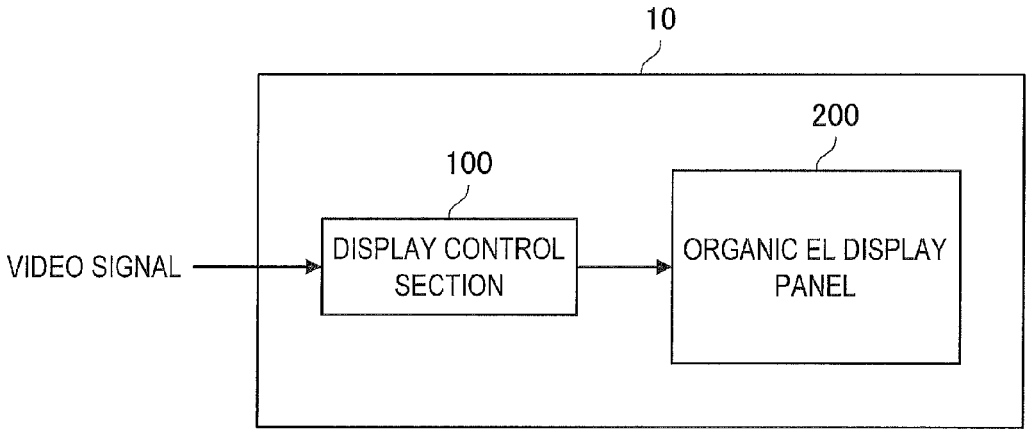
FIG. 1 is an explanatory diagram which describes a configuration example of a self-luminous display device 10 according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be given in the following order.

<1. The embodiments of the present disclosure>

[Configuration example of the self-luminous display device]

[Configuration example of the display control section]

[Configuration example of the risk and stillness detection section]

[Example of luminance control and image persistence prevention control]

[Example of the WRGB conversion process using a risk map for partial control]

<2. Conclusion>

<1. The embodiments of the present disclosure>

[Configuration Example of the Self-Luminous Display Device]

First, a configuration example of a self-luminous display device according to an embodiment of the present disclosure will be described while referring to the figures. FIG. 1 is an explanatory diagram which describes a configuration example of a self-luminous display device 10 according to an embodiment of the present disclosure. Hereinafter, a configuration example of the self-luminous display device 10 according to an embodiment of the present disclosure will be described by using FIG. 1.

The self-luminous display device 10 shown in FIG. 1 is a device which displays a video on an organic EL display panel 200 using organic EL elements which emit light by the elements themselves when a voltage is applied. As shown in FIG. 1, the self-luminous display device 10 according to an embodiment of the present disclosure includes a display control section 100 and the organic EL display panel 200. When the supply of a video signal is received, the self-luminous display device 10 analyses this video signal, and displays a video via the organic EL display panel 200, by lighting pixels arranged within the organic EL display panel 200 in accordance with the analyzed contents.

The display control section 100 supplies, to the organic EL display panel 200, signals for displaying a video on the organic EL display panel 200, by applying signal processing to the video signal supplied to the self-luminous display device 10. For example, the signal processing executed by the display control section 100 is a process which controls the luminance at the time when performing display, or is an image persistence prevention process for preventing image persistence of the screen on the organic EL display panel 200. A detailed configuration of the display control section 100 will be described later.

The organic EL display panel 200 is a display panel using organic EL elements which emit light by the elements themselves when a voltage is applied such as described above, and has a configuration in which the pixels of the organic EL elements are arranged in a matrix shape. While not illustrated in FIG. 1, the organic EL display panel 200 has a configuration, in which scanning lines which select pixels in a prescribed scanning period, data lines which provide luminance information for driving the pixels, and pixel circuits which control the current amount based on the luminance information and allow the organic EL elements to emit light by light emitting elements in accordance with the current amount, are arranged in a matrix, and by having such a configuration of the scanning lines, data lines and pixel circuits, the self-luminous display device 10 can display a video in accordance with a video signal.

The organic EL display panel 200 according to an embodiment of the present disclosure may be a display panel which displays images with the three primary colors of R (red), G (green) and B (blue), or may be a display panel which displays images with four colors which includes W (white) in addition to the three primary colors. In the following description, the organic EL display panel 200 according to an embodiment of the present disclosure will be described as a display panel which displays images with the four colors of R, G, B, W.

Heretofore, a configuration example of the self-luminous display device 10 according to an embodiment of the present disclosure has been described by using FIG. 1. Next, a configuration example of the display control section 100 included in the self-luminous display device 10 according to an embodiment of the present disclosure will be described.

[Configuration Example of the Display Control Section]

Figure 2:
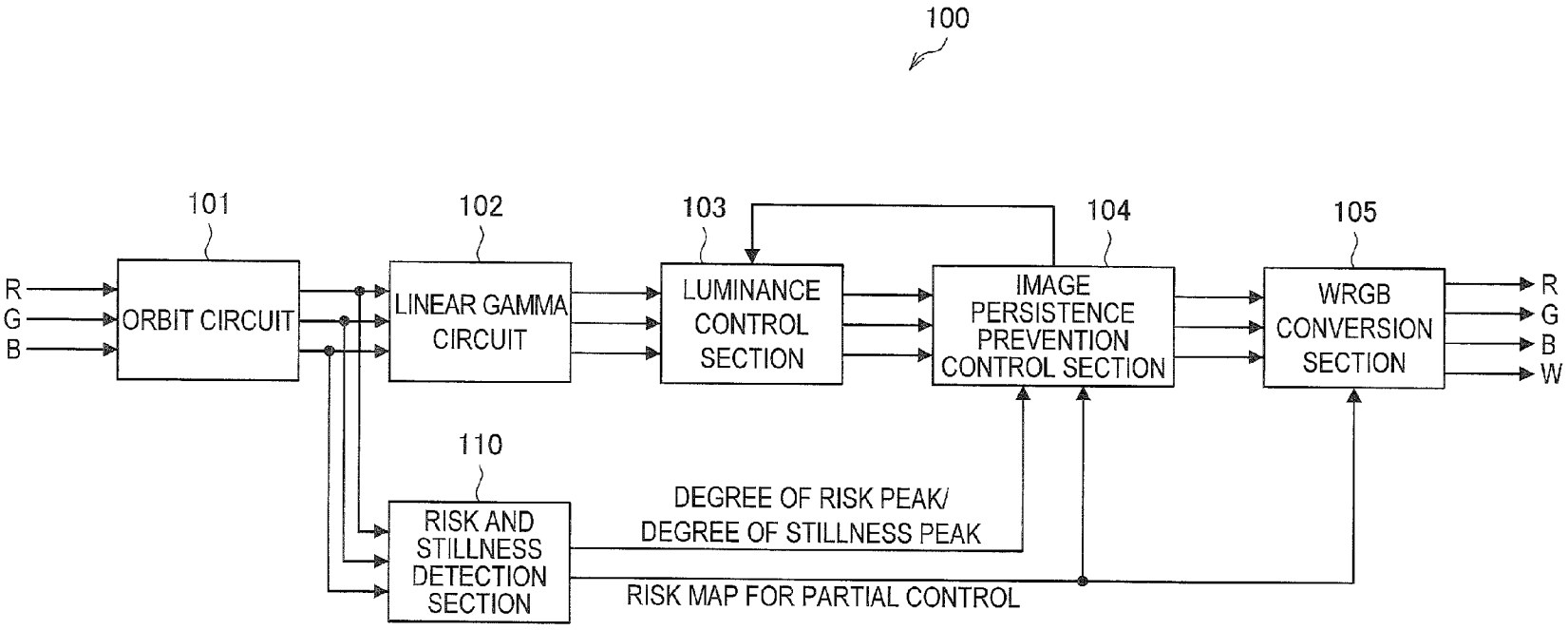
FIG. 2 is an explanatory diagram which shows a configuration example of a display control section 100.

FIG. 2 is an explanatory diagram which shows a configuration example of the display control section 100 included in the self-luminous display device 10 according to an embodiment of the present disclosure. Hereinafter, a configuration example of the display control section 100 included in the self-luminous display device 10 according to an embodiment of the present disclosure will be described by using FIG. 2.

The display control section 100 shown in FIG. 2 executes signal processing on a video signal of each of the three supplied colors R (red), G (green) and B (blue). As shown in FIG. 2, the display control section 100 included in the self-luminous display device 10 according to an embodiment of the present disclosure includes an orbit circuit 101, a linear gamma circuit 102, a luminance control section 103, an image persistence prevention control section 104, a WRGB conversion section 105, and a risk and stillness detection section 110.

The orbit circuit 101 performs signal processing (an orbit process) for blurring the edges of a supplied video signal. Specifically, in order to prevent an image persistence phenomenon of an image on the organic EL display panel 200, the orbit circuit 101 executes a process which suppresses an image persistence phenomenon of the image by allowing the entire image displayed on the organic EL display panel 200 to periodically deviate up-down and left-right, at a slow speed to the extent that a viewer will not comprehend it. The orbit circuit 101 supplies the video signal to which the orbit process has been executed to the linear gamma circuit 102 and the risk and stillness detection section 110.

The linear gamma circuit 102 performs signal processing to convert a video signal, in which the output for an input has a gamma characteristic, so as to have a linear characteristic from the gamma characteristic. By performing signal processing in the linear gamma circuit 102 so that the output for an input has a linear characteristic, various processes for an image displayed on the organic EL display panel 200 become easy. The linear gamma circuit 102 supplies the signal after conversion to the overall luminance control section 103.

The luminance control section 103 executes a gain process for controlling the luminance when displaying a video on the organic EL display panel 200, for the video signal converted in the linear gamma circuit 102 so as to have a linear characteristic. The luminance control section 103 executes a gain process for a video signal which has a luminance equal to or more than a prescribed level, for example, so that the luminance becomes equal to or less than the prescribed level. The luminance control section 103 supplies the video signal after the gain process has been executed to the image persistence prevention control section 104.

The image persistence prevention control section 104 executes luminance control for preventing image persistence, in the case where there is the possibility of image persistence occurring on the organic EL display panel 200, for the video signal after the gain process has been performed by the luminance control section 103. The image persistence prevention control section 104 uses data generated in the risk and stillness detection section 110, when executing luminance control for preventing image persistence. The data generated in the risk and stillness detection section 110 will be described later. The image persistence prevention control section 104 supplies the video signal after luminance control for preventing image persistence has been executed to the WRGB conversion section 105.

The WRGB conversion section 105 converts the video signal, to which luminance control for preventing image persistence has been performed by the image persistence prevention control section 104, into a video signal for displaying a video with the 4 colors R, G, B, W on the organic EL display panel 200. The WRGB conversion section 105 uses data generated in the risk and stillness detection section 110, when executing a conversion process of the video signal. The video signal converted by the WRGB conversion section 105 is converted again so as to have a gamma characteristic when displayed on the organic EL display panel 200, and is thereafter supplied to the organic EL display panel 200.

The risk and stillness detection section 110 obtains a position, on the organic EL display panel 200, at which there is a high possibility of an image persistence phenomenon occurring, by using the video signal supplied from the orbit circuit 101, and outputs this position information to the image persistence prevention control section 104 and the WRGB conversion section 105. As described above, in organic EL elements, the luminance characteristics will deteriorate when a voltage is continuously applied, and the luminance will decrease even if the same current is input. As a result of this, in the case where the luminance frequency of specific pixels is high, the luminance characteristics of these specific pixels will be deteriorated when compared to the luminance characteristics of the other pixels. This is the phenomenon which is called "image persistence".

The risk and stillness detection section 110 generates information (a map) which specifies the location of the pixels which have a high luminance frequency, by using the video signal output from the orbit circuit 101. Also, the risk and stillness detection section 110 sends, to the image persistence prevention control section 104, a peak value of the degree of risk, which includes the time and luminance at which light has been continuously emitted, for the pixels which have a high luminance frequency (a high risk of image persistence). By controlling the luminance by using a peak value of the degree of risk, the image persistence prevention control section 104 can prevent the generation of an image persistence phenomenon on the organic EL display panel 200.

Figure 3:
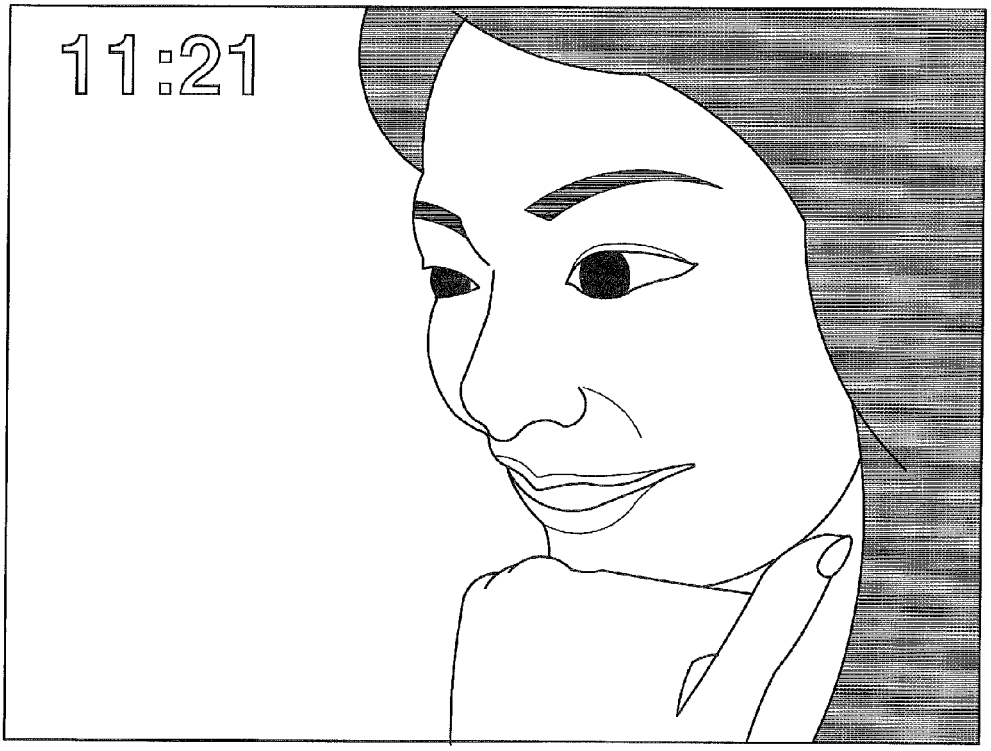
FIG. 3 is an explanatory diagram which shows an example of an image displayed on the self-luminous display device 10.

For example, as shown in FIG. 3, a video which continuously displays the current time on a portion of the screen is supplied to the self-luminous display device 10. Since the time display portion on the upper left in FIG. 3 is displayed at a luminance higher to some extent than that normally, there is a high risk of image persistence for the pixels which display the time, and the degree of risk will rise in accordance with the passing of time as long as the time is continuously displayed.

Figure 4:
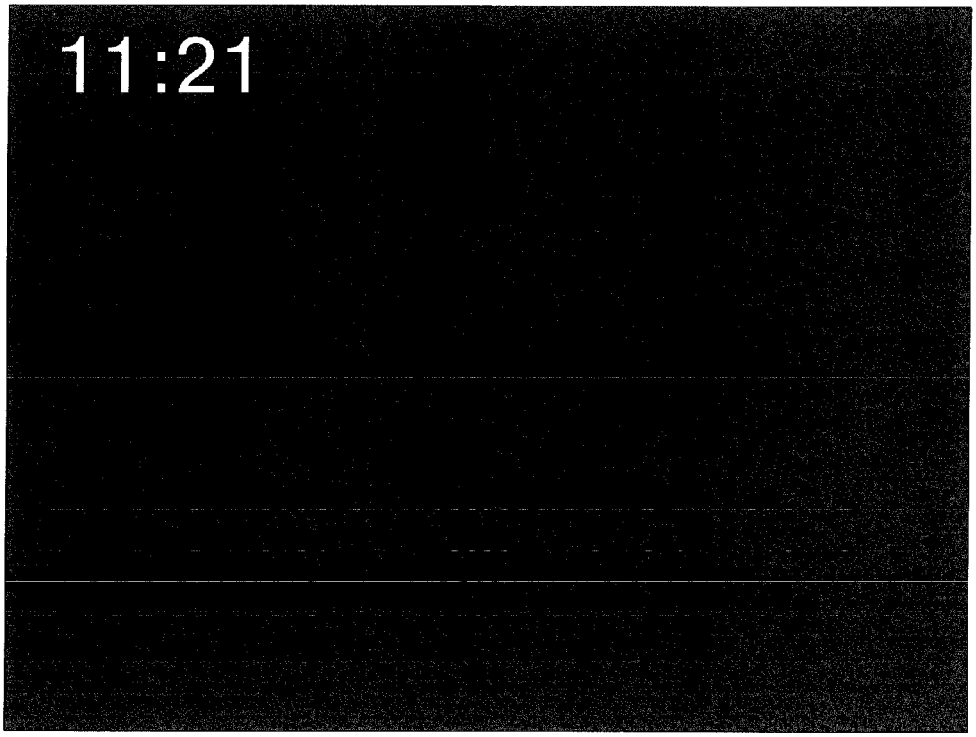
FIG. 4 is an explanatory diagram which shows an example of a risk map.

Accordingly, the risk and stillness detection section 110 shows that the degree of risk is rising for the pixels which display the time, by generating a risk map such as shown in FIG. 4. While the pixels other than those in the time display portion do not have a large rise in the degree of risk since the displayed image changes, since the degree of risk rises in accordance with the passing of time as long as the pixels of the time display portion continuously display the time, the value of the degree of risk will increase in the risk map for the pixels of the time display portion.

The risk and stillness detection section 110 performs detection of a still image. Since an image persistence phenomenon occurs by the deterioration of specific pixels when the same still image is continuously displayed for a long period of time, the risk and stillness detection section 110 obtains a parameter called the degree of stillness, which is similar to the above described degree of risk, and generates information (a map) which specifies the location of the pixels which have a high luminance frequency.

Also, the risk and stillness detection section 110 sends, to the image persistence prevention control section 104, a peak value of the degree of stillness, which includes the time and luminance at which light has been continuously emitted, for the pixels which have a high luminance frequency (a high risk of image persistence). By controlling the luminance by using a peak value of the degree of stillness, the image persistence prevention control section 104 can prevent the generation of an image persistence phenomenon on the organic EL display panel 200.

The generation of a risk map and a stillness map in the risk and stillness detection section 110 are not processes for one pixel unit. Therefore, the risk and stillness detection section 110 generates a risk map and a stillness map, by detecting the video signal after an orbit process has been performed by the orbit circuit 101.

By considering not only the case where the luminance of the entire screen is controlled for preventing image persistence, but also the case where the luminance is controlled for a portion of the screen for preventing image persistence, the risk and stillness detection section 110 generates a risk map for partial control, in the image persistence prevention control section 104, for controlling a portion of the screen. By generating a risk map for partial control by the risk and stillness detection section 110, the image persistence prevention control section 104 can control luminance without having an impact on the image quality, for a portion of the screen, in order to prevent image persistence.

When a risk map for partial control is generated, the risk and stillness detection section 110 supplies this risk map for partial control to the WRGB conversion section 105 as well as to the image persistence prevention control section 104. By using a risk map for partial control, the WRGB conversion section 105 is capable of performing luminance control, for a portion of the screen, when converting a video with the four colors R, G, B, W into a video signal for displaying on the organic EL display panel 200.

Note that while not shown in FIG. 2, a circuit for reconverting the video signal, which has been converted so as to have a linear characteristic in the linear gamma circuit 102, in order to display a video on the organic EL display panel 200, may be included in a later stage of the WRGB conversion section 105.

Heretofore, a configuration example of the display control section 100 included in the self-luminous display device 10 according to an embodiment of the present disclosure has been described by using FIG. 2. Next, a configuration example of the risk and stillness detection section 110 according to an embodiment of the present disclosure will be described.

[Configuration Example of the Risk and Stillness Detection Section]

Figure 5:
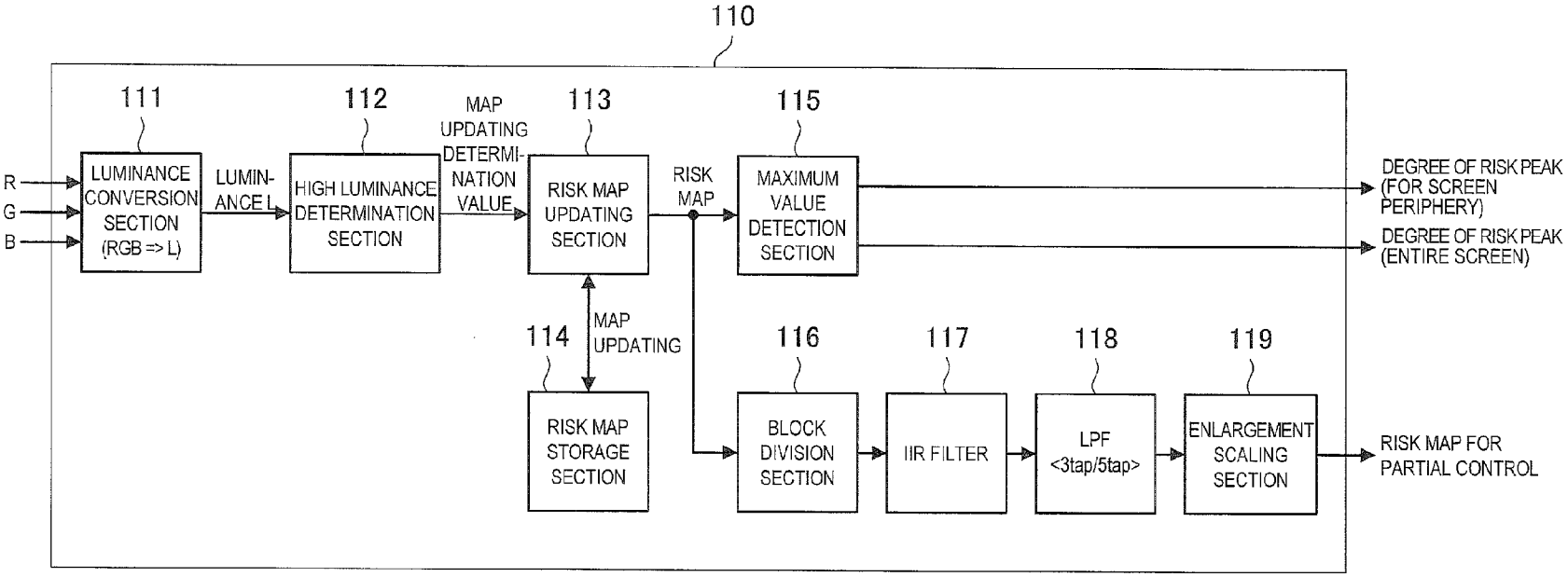
FIG. 5 is an explanatory diagram which shows a configuration example of a risk and stillness detection section 110.

FIG. 5 is an explanatory diagram which shows a configuration example of the risk and stillness detection section 110 according to an embodiment of the present disclosure. The explanatory diagram shown in FIG. 5 is a configuration example of the risk and stillness detection section 110 for generating a risk map. Hereinafter, a configuration example of the risk and stillness detection section 110 according to an embodiment of the present disclosure will be described by using FIG. 5.

As shown in FIG. 5, the risk and stillness detection section 110 according to an embodiment of the present disclosure includes a luminance conversion section 111, a high luminance determination section 112, a risk map updating section 113, a risk map storage section 114, a maximum value detection section 115, a block division section 116, an IIR filter 117, a low-pass filter (LPF) 118, and an enlargement scaling section 119.

The luminance conversion section 111 obtains a luminance of each color for a video signal supplied to the risk and stillness detection section 110, and supplies an additional luminance L for the color which has a maximum luminance to the high luminance determination section 112.

Figure 6:
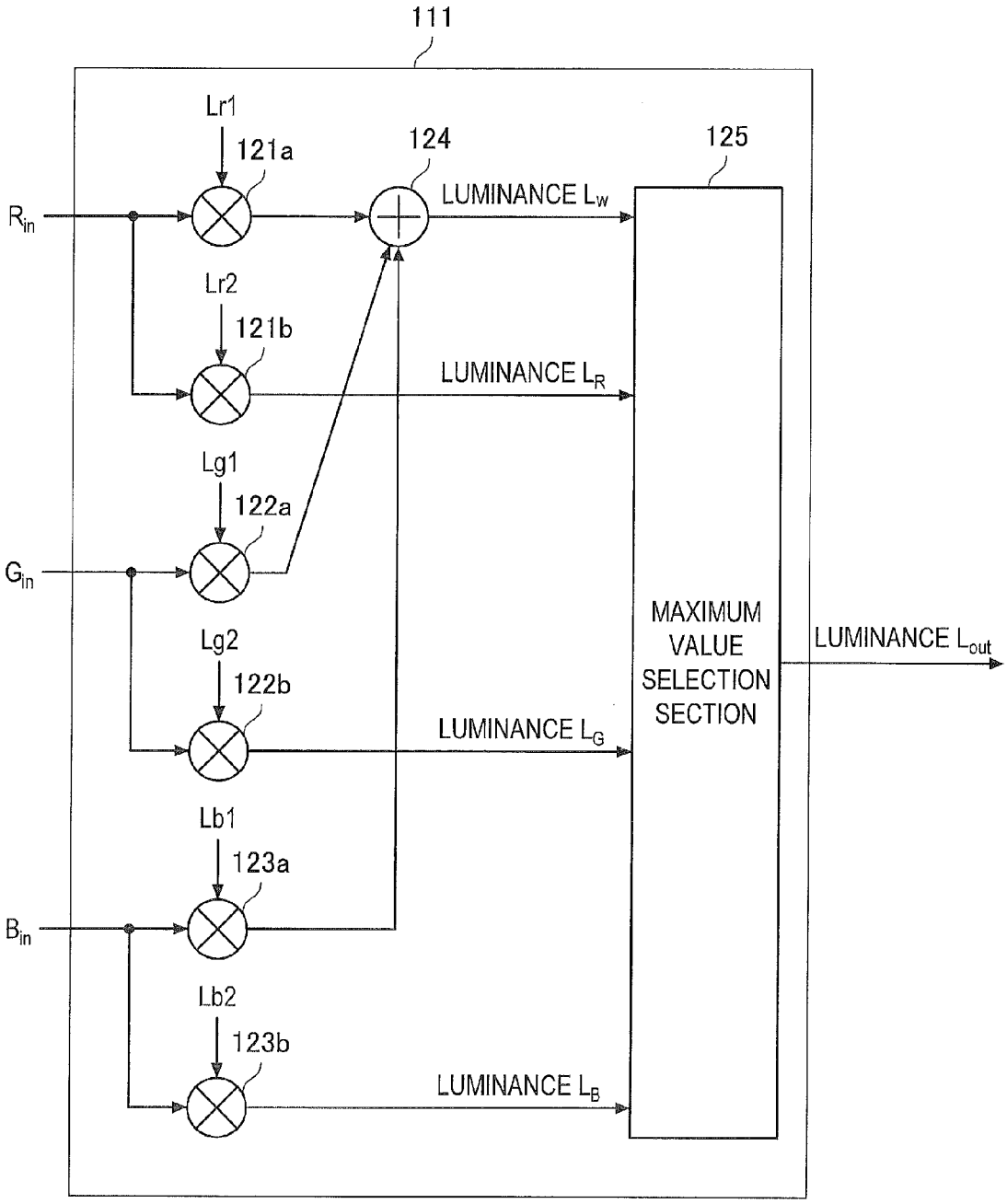
FIG. 6 is an explanatory diagram which shows a configuration example of a luminance conversion section 111.

FIG. 6 is an explanatory diagram which shows a configuration example of the luminance conversion section 111. As shown in FIG. 6, the luminance conversion section 111 includes multipliers 121*a*, 121*b*, 122*a*, 122*b*, 123*a* and 123*b*, an adder 124, and a maximum value selection section 125.

The multiplier 121*a* is included for converting to signals in order to obtain a white luminance along with the other colors, by multiplying a prescribed coefficient Lr1 for a red video signal $R_{in}$. Similarly, the multiplier 122*a* multiplies a prescribed coefficient Lg1 for a green video signal $G_{in}$, and the multiplier 123*a* multiplies a prescribed coefficient Lb1 for a blue video signal $B_{in}$. The adder 124 adds the outputs from the multipliers 121*a*, 122*a* and 123*a*, and outputs the addition result.

The multiplier 121*b* is included in order to convert to a signal for obtaining a red monochrome luminance, by multiplying a prescribed coefficient Lr2 by the red video signal $R_{in}$. Similarly, the multiplier 122*b* multiplies a prescribed coefficient Lg2 by the green video signal $G_{in}$, and the multiplier 123*b* multiplies a prescribed coefficient Lb2 by the blue video signal $B_{in}$.

The processes by the multipliers 121*a*, 121*b*, 122*a*, 122*b*, 123*a* and 123*b* and the adder 124 are represented by the following equations.

$$L_W = R\text{in}*Lr1 + G\text{in}*Lg1 + B\text{in}*Lb1$$

$$L_R = R\text{in}*Lr2$$

$L_G = G\text{in} * Lg2$ $L_B = B\text{in} * Lb2$

The maximum value selection section 125 selects the maximum value from among $L_W$, $L_R$, $L_G$ and $L_B$ obtained by the above described equations, and outputs the maximum value as a luminance $L_{out}$. The process of the maximum value selection section 125 is represented by the following equation.

$L_{out} = \text{Max}(L_W, L_R, L_G, L_B)$

The high luminance determination section 112 outputs, to the risk map updating section 113, a map updating determination value of whether or not a risk map generated by the risk map updating section 113 is updated, by performing a threshold determination of luminance in prescribed block units for the luminance L output from the luminance conversion section 111. In the present embodiment, the high luminance determination section 112 divides one screen into blocks of 8×8 pixel units, and performs a threshold determination of luminance by these unit blocks. For example, a relation example between the luminance and the determination value is represented as follows in the case where four thresholds (th1, th2, th3 and th4) are included.

if $(L > th1) Jv = p_r1$ elseif $(L > th2) Jv = p_r2$ elseif $(L > th3) Jv = p_r3$ elseif $(L > th4) Jv = p_r4$ else $Jv = p_r5$ In the above described relation example, p_r1~p_r5 are parameters, and are values capable of being set in a range of −255~+255, for example.

The risk map updating section 113 generates and updates the risk map by using the map updating determination value supplied from the high luminance determination section 112. In the present embodiment, history data is generated by having the determination value added in block units. The data length of this history data is 8 bits per one block. Also, in the present embodiment, a risk map for the entire screen is generated by this history data. The risk map updating section 113 stores the generated and updated risk map in the risk map storage section 114. Further, when the risk map is updated, the risk map updating section 113 supplies the updated risk map to the maximum value detection section 115.

The risk map updating section 113 adds the determination value supplied from the high luminance determination section 112 to each of the blocks. That is, the history data increases if the determination value supplied from the high luminance determination section 112 is a positive value, and the history data decreases if the determination value is a negative value. If it is assumed that the history data of the current point is riskmap (x,y), the history data immediately prior is riskmap_old (x,y), and the determination value of the current point is Jv (x,y), riskmap (x,y) can be obtained by the following equation. Note that x,y shows both the horizontal and the vertical block positions.

$\text{riskmap}(x,y) = \text{riskmap_old}(x,y) + Jv(x,y)$

Note that if the determination value is a positive value, the risk map updating section 113 updates the risk map at a set updating interval. On the other hand, if the determination value is a negative value, the risk map updating section 113 immediately updates the risk map without depending on a setting parameter of the updating interval, and resets the degree of risk for this block to 0. That is, it may be necessary for the determination value to be a positive value over a long period of time, in order for the degree of risk to be counted up. A plurality of updating interval parameters may be retained so as to be capable of separating cases in accordance with the value of the degree of risk. Hereinafter, setting examples of updating interval parameters are shown.

Degree of risk 0~r1: update1 <For time control up to the start of multiplying the gain process>

Degree of risk r1~r2: update2 <For time control during the time of multiplying the gain process>

Degree of risk r2~r3: update3 <For time control up to a second gain process>

Degree of risk r3~r4: update4 <For time control during the time of the second gain process>

The risk map updating section 113 may update the risk map at an interval set by the above described update1~update4. Note that, since it is assumed to be a process of partial units, the updating interval parameter is capable of being set at 20 bits.

Note that, only in the case where the degree of risk is counted up from 0 may the risk map updating section 113 immediately reflect this in the risk map without depending on an updating interval parameter. This is because the case where the value is 0 is a state in which the degree of risk is has been reset.

Figure 7:
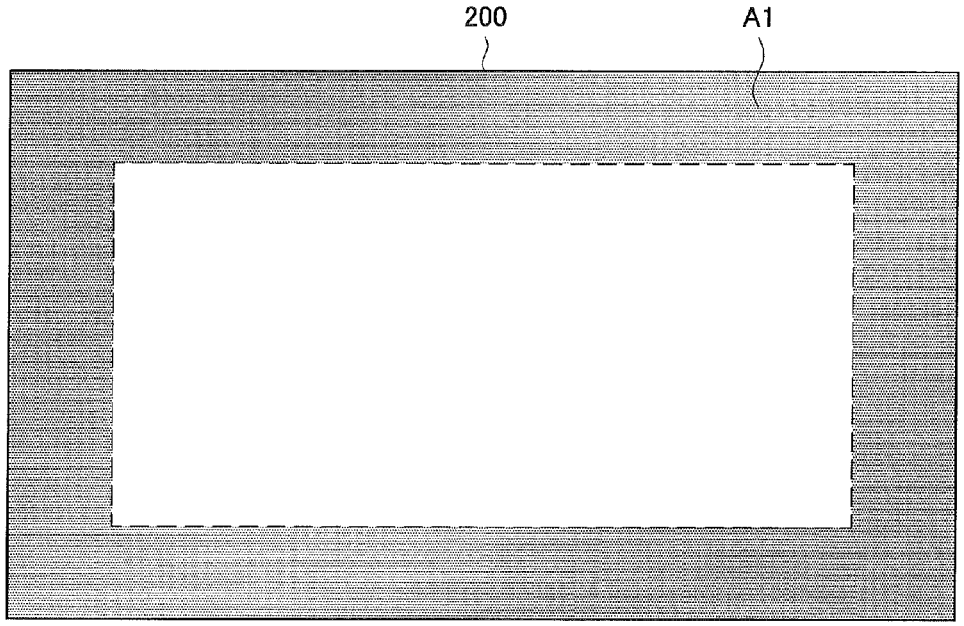
FIG. 7 is an explanatory diagram which shows an example of a peripheral part of a screen on the organic EL display panel 200.

The maximum value detection section 115 detects the maximum value in the risk map updated by the risk map updating section 113, and outputs this maximum value. In the present embodiment, the maximum value detection section 115 outputs the maximum value of the degree of risk for the entire screen, and the maximum value of the degree of risk for a peripheral part of the screen. FIG. 7 is an explanatory diagram which shows an example of a peripheral part of the screen on the organic EL display panel 200. The maximum value detection section 115 outputs the maximum value of the degree of risk for the entire screen, and the maximum value of the degree of risk for a peripheral part of the screen A1. Note that, the range of the peripheral part of the screen A1 is capable of being changed by a setting of a register.

In this way, since not only the maximum value of the degree of risk for the entire screen, but also the maximum value of the degree of risk for the peripheral part of the screen is output by the maximum value detection section 115, image persistence is likely to occur, in particular, in the peripheral part of the screen. There are many cases where information, such as the current time shown in FIG. 3 or subtitles, are displayed on the peripheral part of the screen. Therefore, by outputting the maximum value of the degree of risk for the peripheral part of the screen by the maximum value detection section 115, it becomes possible to perform luminance control for the peripheral part of the screen at which image persistence is likely to occur.

The block division section 116 divides the risk map supplied from the risk map updating section 113 into blocks of a large size (large blocks) by integrating a plurality of the blocks of the risk map. The block division section 116 divides the risk map generated by units of 8 pixels×8 pixels, for example, into large blocks of a size of 16 pixels×16 pixels. Note that, the division units by the block division section 116 are capable of being changed by a setting.

Figure 8:
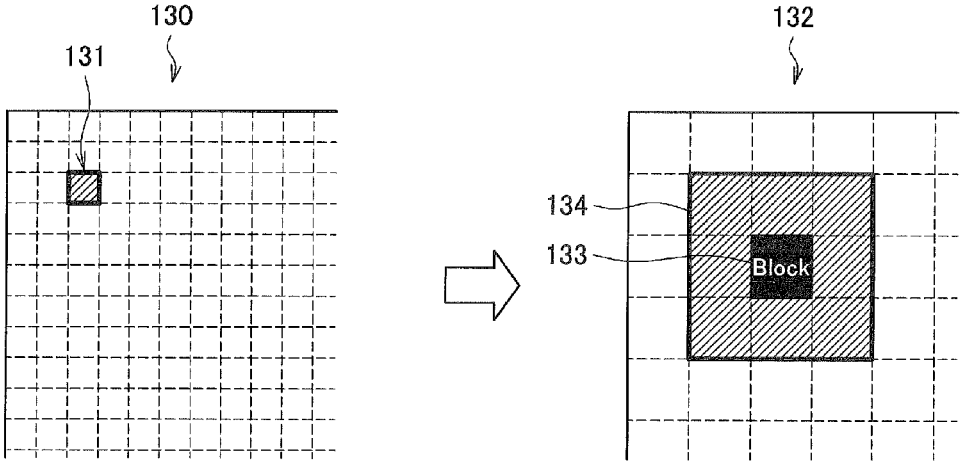
FIG. 8 is an explanatory diagram which shows an example of large block division of a risk map by a block division section 116.

FIG. 8 is an explanatory diagram which shows an example of large block division of the risk map by the block division section 116. The reference numeral 130 shown on the left side of FIG. 8 is a risk map generated by units of 8 pixels×8 pixels, for example, and the reference numeral 131 represents one block in the risk map. Also, the reference numeral 132 shown on the right side of FIG. 8 is a state in which the risk map represented by the reference numeral 130 is divided into large blocks, so that one large block 133 becomes a size of 16 pixels×16 pixels.

Also, when the risk map is divided into large blocks, the block division section 116 searches for the maximum value of the degree of risk, by setting each of the large blocks and the 8 large blocks surrounding each of these large blocks as a target, and outputs this maximum value. The 9 large blocks represented by the reference numeral 134 in FIG. 8 becomes the search range of a maximum value of the degree of risk for the large block represented by the reference numeral 133.

Note that, in the case where the search range protrudes outside of the screen, the block division section 116 sets this protruding range as a search range excluded from the range to be searched. Further, while the division units by the block division section 116 are capable of being changed by a setting, there may be cases where the boundaries of the large blocks divided by the block division section 116 and the boundaries of the blocks of the risk map do not match each other, as a result of being updated. In this case, a search may be performed by having the blocks of the risk map on the boundaries of the large blocks, which are divided by the block division section 116, superimposed on different large blocks.

The IIR filter 117 is an IIR filter applied to the maximum value of the degree of risk for each block searched for by the block division section 116. The IIR filter 117 applies an IIR filter which is expressed by the following equation.

$$Y_n = X_n + K(\Delta X_n)*(Y_{n-1} - X_n)$$

Figure 9:
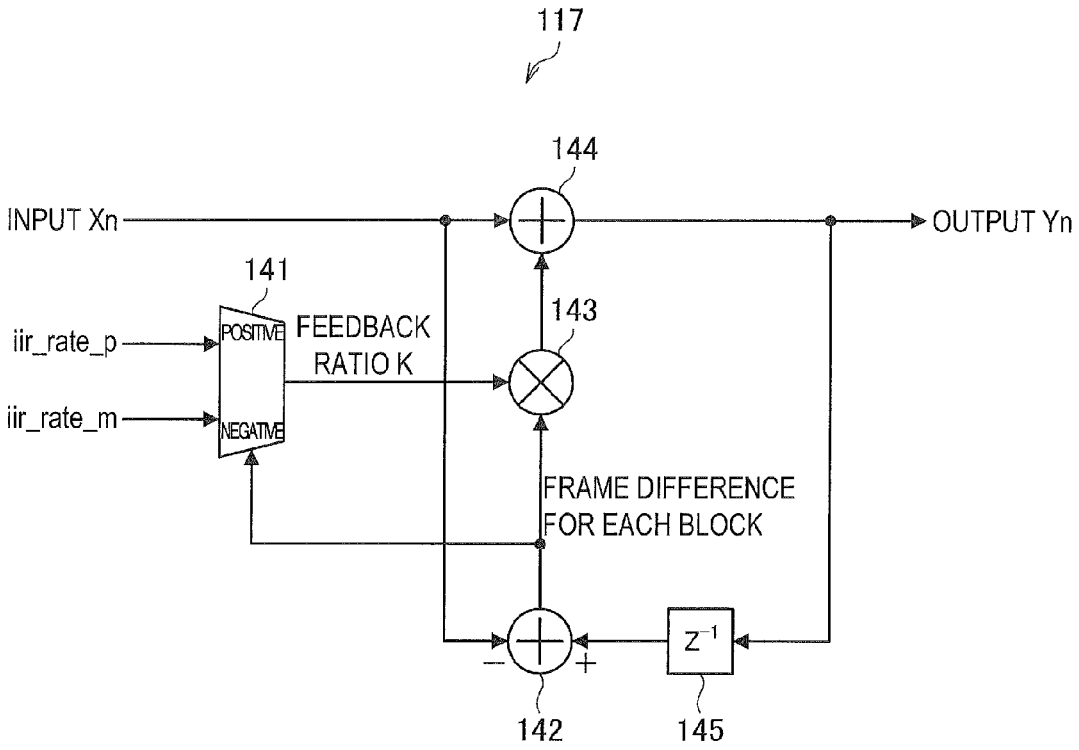
FIG. 9 is an explanatory diagram which shows a configuration example of an IIR filter 117.

FIG. 9 is an explanatory diagram which shows a configuration example of the IIR filter 117 for implementing the above described equation. As shown in FIG. 9, the IIR filter 117 includes a selector 141, adders 142 and 144, a multiplier 143, and a delayer 145.

The selector 141 selects one value out of the two values (iir_rate_p, iir_rate_m) in accordance with a positive value of the difference between frames for each block in the adder 142, and outputs the selected value as a feedback ratio K. The adder 142 subtracts an input value $X_n$ of the current frame from an output value $Y_{n-1}$ of the previous frame, and outputs the subtraction result. The multiplier 143 multiplies the feedback ratio K output from the selector 141 by the output of the adder 142 ($Y_{n-1}-X_n$), and outputs the multiplication result. The adder 144 multiplies the output of the multiplier 143 by the input value $X_n$ of the current frame, and outputs the multiplication result. The delayer 145 outputs the output of the adder 144 to the adder 142 with a one frame delay.

Figure 10:
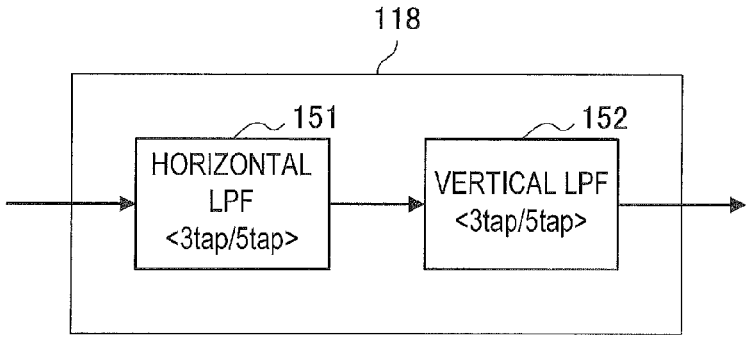
FIG. 10 is an explanatory diagram which shows a configuration example of an LPF 118.

The LPF 118 applies an LPF for both a horizontal direction and a vertical direction to the output of the IIR filter 117, and outputs the applied LPF to the enlargement scaling section 119. FIG. 10 is an explanatory diagram which shows a configuration example of the LPF 118. As shown in FIG. 10, the LPF 118 includes a horizontal LPF 151 which applies an LPF to the horizontal direction, and a vertical LPF 152 which applies an LPF to the vertical direction.

Note that a tap number of 3 taps or 5 taps is capable of being selected for the horizontal LPF 151 and the vertical LPF 152 shown in FIG. 10.

The enlargement scaling section 119 executes a process, for the output of the LPF 118, which enlarges the value of the degree of risk retained in the large block units into pixel units. The enlargement scaling section 119 performs linear interpolation between the large blocks, when enlarging the value of the degree of risk into pixel units. Further, the enlargement scaling section 119 may be configured to be capable of selecting, for the process at the screen edge parts, whether to perform extrapolation or whether to retain the values of the large blocks.

Note that, since the division unit of large blocks by the block division section 116 is capable of being changed by a setting, the enlargement scaling section 119 performs linear interpolation for the value of the degree of risk by using and multiplying parameters corresponding to a division process.

In this way, the risk and stillness detection section 110 generates a risk map for partial control, by dividing the risk map into large block units, and thereafter passing through the IIR filter 117 and the LPF 118 and performing linear interpolation by the enlargement scaling section 119. By generating such a risk map for partial control, the risk and stillness detection section 110 can execute luminance control for preventing image persistence for some portion of the screen, so that a difference in luminance with the other portions is not prominent.

The block division section 116, the IIR filter 117 and the LPF 118 shown in FIG. 5 function as an example of a resampling section of the present disclosure. That is, the block division section 116 divides the risk map in block units larger than the blocks to be calculated by the risk map updating section 113, and the IIR filter 117 and the LPF 118 perform resampling of the risk map divided by the block division section 116.

Up to here, a configuration example of the risk and stillness detection section 110 for generating a risk map has been described. To continue, a configuration example of the risk and stillness detection section 110 for generating a stillness map will be described.

Figure 11:
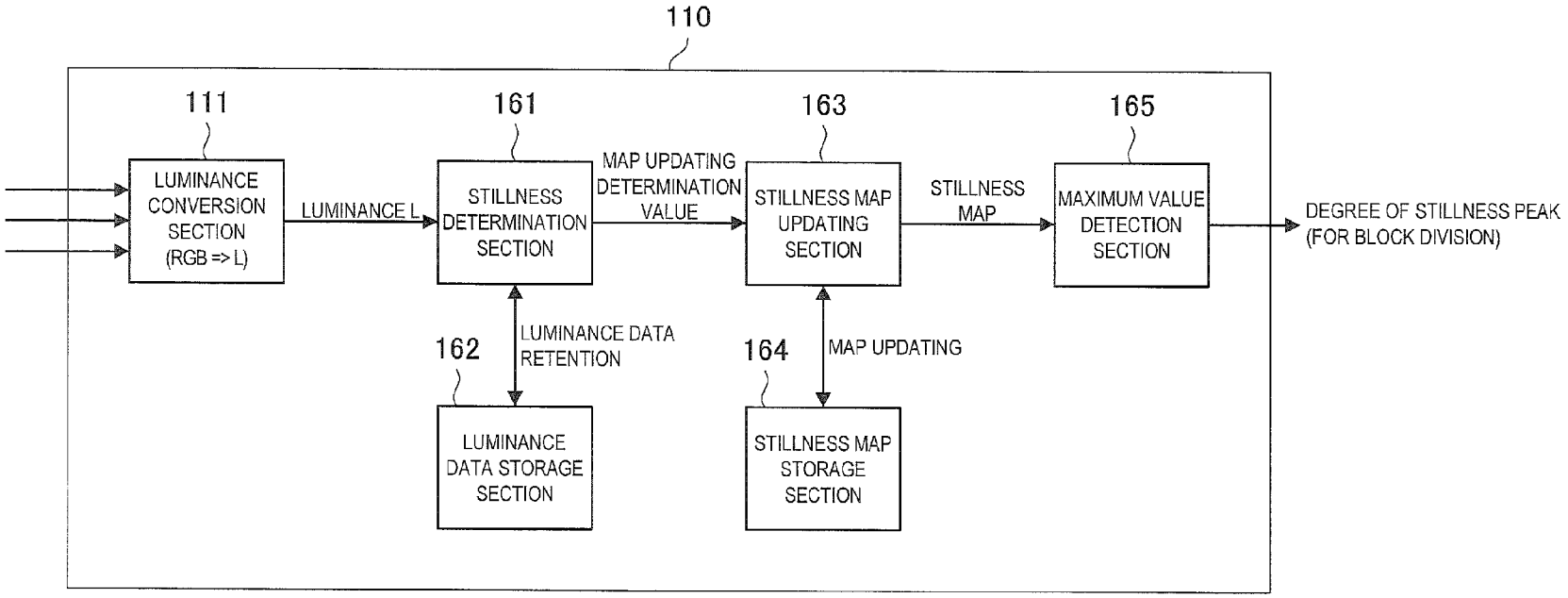
FIG. 11 is an explanatory diagram which shows a configuration example of the risk and stillness detection section 110 according to an embodiment of the present disclosure.

FIG. 11 is an explanatory diagram which shows a configuration example of the risk and stillness detection section 110 according to an embodiment of the present disclosure. The explanatory diagram shown in FIG. 11 is a configuration example of the risk and stillness detection section 110 for generating a stillness map. Hereinafter, a configuration example of the risk and stillness detection section 110 according to an embodiment of the present disclosure will be described by using FIG. 11.

As shown in FIG. 11, the risk and stillness detection section 110 according to an embodiment of the present disclosure includes a luminance conversion section 111, a stillness determination section 161, a luminance data storage section 162, a stillness map updating section 163, a stillness map storage section 164, and a maximum value detection section 165.

The luminance conversion section 111 obtains a luminance of each color for a video signal supplied to the risk and stillness detection section 110, and supplies an additional luminance L for the color which has a maximum luminance to the stillness determination section 161. A configuration example of the luminance conversion section 111 is shown in FIG. 6, for example.

Figure 12:
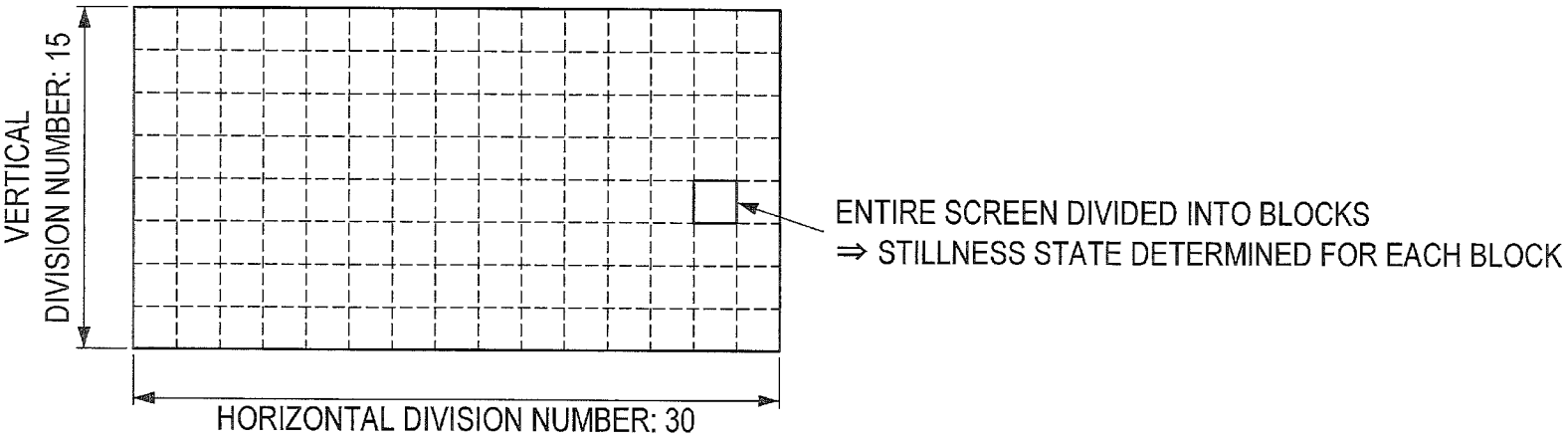
FIG. 12 is an explanatory diagram which shows an example of a screen divided into blocks when the risk and stillness detection section 110 generates a stillness map.

The stillness determination section 161 obtains an average luminance for the entire screen and an average luminance for each block when the screen is divided into blocks of a prescribed size, and determines a degree of stillness of a video for each of the blocks. FIG. 12 is an explanatory diagram which shows an example in which the screen in divided into blocks when the risk and stillness detection section 110 generates a stillness map. When the risk and stillness detection section 110 generates a stillness map, blocks are created by dividing the screen into 15 blocks in the vertical direction and 30 blocks in the horizontal direction, such as shown in FIG. 12, for example, and a stillness state of a video is determined for each of these blocks.

When an average luminance for the entire screen and an average luminance for each block are obtained, the stillness determination section 161 retains information of the average luminance in the luminance data storage section 162. Note that, it may not be necessary for the stillness determination section 161 to divide strictly by the number of pixels when obtaining an average luminance, and the average luminance may be obtained by performing standardization by bit shifting.

Also, the stillness determination section 161 obtains a difference of the average luminance with that of the previous frame for each block, and by comparing a threshold determination of the difference values of the average luminance with the average luminance for the entire screen and the average luminance for each block, a stillness state of the video is determined, and a determination value is sent to the stillness map updating section 163. If the average luminance for the entire screen is low, and the average luminance for the entire screen and the average luminance for each block are of approximately at the same level, the stillness determination section 161 does not determine that the video has a stillness state.

A determination process of a stillness state by the stillness determination section 161 will be described in more detail. A determination process of a stillness state by the stillness determination section 161 is executed according to the various condition determination processes shown below.

<Condition 1>

The stillness determination section 161 judges whether or not a difference between frames of the average luminance for each block is equal to or less than a threshold th_still. If a difference between frames of the average luminance for each block is equal to or less than the threshold th_still, the stillness determination section 161 proceeds to the next condition.

<Condition 1-1>

The stillness determination section 161 judges whether or not the average luminance for the entire screen is equal to or less than a threshold th_level, and whether or not a difference between the average luminance for the entire screen and the average luminance for each block is equal to a threshold th_inout. If this condition is satisfied, the stillness determination section 161 sets a determination value Jv as p_s1(+1).

<Condition 1-2>

In the case where condition 1-1 is not satisfied, the stillness determination section 161 sets the determination value Jv as p_s2(+1 or −255).

<Condition 2>

In the case where condition 1 is not satisfied, the stillness determination section 161 sets the determination value Jv as p_s3(−255).

A determination process of this stillness state by the stillness determination section 161 is represented as follows.

```
if((APL_{N-1} − APL_N) < th_still){
  if((ALL_APL_N < th_level)&&(ALL_APL_N − APL_N) < th_inout)
      Jv = p_s1
    else
      Jv = p_s2
}else
      Jv = p_s3
```

The stillness map updating section 163 generates a stillness map, by updating the degree of stillness for each block by using the determination value determined by the stillness determination section 161. The stillness map updating section 163 adds the determination value, retained in each block and determined by the stillness determination section 161, to history data of the degree of stillness stored in the stillness map storage section 164. The history data increases if the determination value determined by the stillness determination section 161 is a positive value, and the history data decreases if the determination value is a negative value.

The calculation of the history data by the stillness map updating section 163 is represented by the following equation. In the following equation, stillmap(area) is history data in the block of a numbered area, stillmap_old(area) is history data in the block of a numbered area prior to updating, and Jv(area) is a determination value in the block of a numbered area.

$$\text{stillmap(area)}=\text{stillmap_old(area)}+Jv\text{(area)}$$

Note that, if the determination value is a positive value, the stillness map updating section 163 updates the stillness map stored in the stillness map storage section 164 at a set updating interval. On the other hand, if the determination value is a negative value, the stillness map updating section 163 immediately updates the stillness map without depending on a setting parameter of the updating interval, and resets the degree of stillness for this block to 0. That is, it may be necessary for the determination value to be a positive value over a long period of time, in order for the degree of stillness to be counted up. A plurality of updating interval parameters may be retained so as to be capable of separating cases in accordance with the value of the degree of stillness. Hereinafter, setting examples of updating interval parameters are shown.

Degree of stillness 0~s1: update1 <For time control up to the start of multiplying the gain process>

Degree of stillness s1~s2: update2 <For time control during the time of multiplying the gain process>

Degree of stillness s2~s3: update3 <For time control up to a second gain process>

Degree of stillness s3~s4: update4 <For time control during the time of the second gain process>

The stillness map updating section 163 may update the stillness map at an interval set by the above described update1~update4. Note that, since it is assumed to be a process of partial units, the updating interval parameter is capable of being set at 20 bits.

Note that only in the case where the degree of stillness is counted up from 0 may the stillness map updating section 163 immediately reflect this is the stillness map without depending on an updating interval parameter. This is because the case where the value is 0 is a state in which the degree of stillness has been reset.

The maximum value detection section 165 detects the maximum value in the stillness map updated by the stillness map updating section 163, and outputs this maximum value. In the present embodiment, the maximum value detection section 165 outputs the maximum value of the degree of stillness in block units, in order to perform luminance control in block units.

Heretofore, a configuration example of the risk and stillness detection section 110 according to an embodiment of the present disclosure has been described. Next, luminance control and image persistence prevention control, using the risk map or the stillness map generated by the risk and stillness detection section 110, will be described.

[Example of Luminance Control and Image Persistence Prevention Control]

Figure 13:
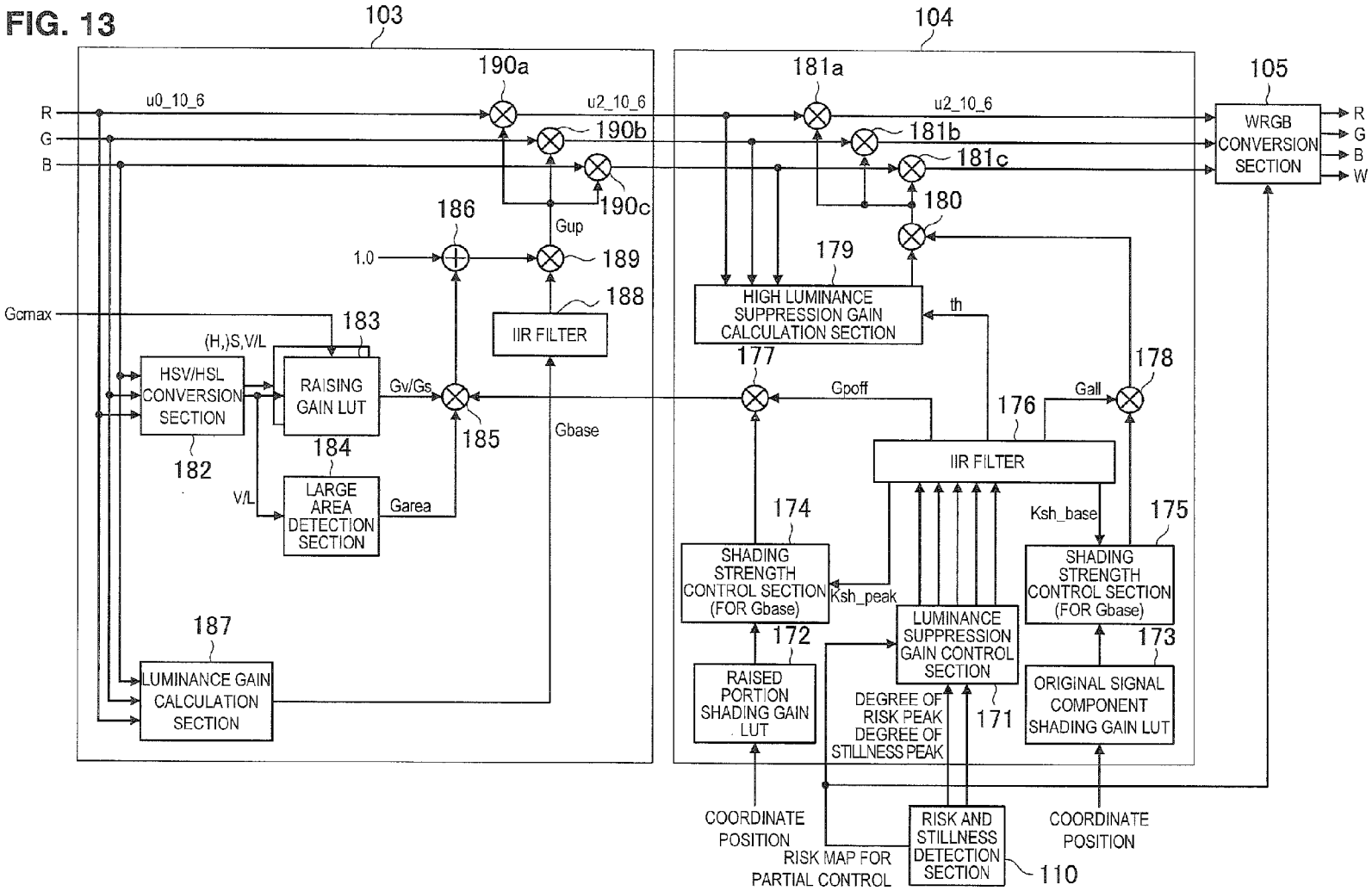
FIG. 13 is an explanatory diagram which shows a configuration example of a luminance control section 103 and an image persistence prevention control section 104 according to an embodiment of the present disclosure.

FIG. 13 is an explanatory diagram which shows a configuration example of the luminance control section 103 and the image persistence prevention control section 104 according to an embodiment of the present disclosure. Hereinafter, a configuration example of the luminance control section 103 and the image persistence prevention control section 104 according to an embodiment of the present disclosure will be described by using FIG. 13.

"ux_y_z" shown in FIG. 13 shows that there is y unsigned bit data, there is an accuracy of z bits, and values can be taken up to x bit times for an input by the application of a gain. That is, "u2_10_6" shows that there is 10 unsigned bit data, there is an accuracy of 6 bits, and values can be taken up to 4 times for the input.

First, a configuration example of the image persistence prevention control section 104 will be described. As shown in FIG. 13, the image persistence prevention control section 104 according to an embodiment of the present disclosure includes a luminance suppression gain control section 171, a raised portion shading gain LUT (Look Up Table) 172, an original signal component shading gain LUT 173, shading strength control sections 174 and 175, an IIR filter 176, multipliers 177, 178, 180, 181*a*, 181*b* and 181*c*, and a high luminance suppression gain calculation section 179.

The luminance suppression gain control section 171 outputs a value and a gain used in the luminance control executed by the image persistence prevention control section 104, by using peak values of the degree of stillness and the degree of risk for the entire screen or for a portion of the screen, and a risk map for partial control, which are output by the risk and stillness detection section 110.

In the present embodiment, the luminance suppression gain control section 171 calculates a threshold (th) which may be necessary in the calculation of a gain for high luminance suppression, a gain (Gall) for controlling the luminance of the entire screen, and a gain (Ksh_base) for controlling the extent to which the luminance of a screen peripheral part is lowered (a shading ratio), by using peak values of the degree of stillness and the degree of risk for the entire screen or for a portion of the screen, and a risk map for partial control. Further, the luminance suppression gain control section 171 obtains a gain (Gpoff) for weakening the gain when performing a process in which an input value of luminance is increased more than the luminance for a signal equal to or more than a prescribed value (a raising process), by the luminance control section 103. Further, the luminance suppression gain control section 171 calculates a gain (Ksh_peak) for controlling the shading ratio of a screen peripheral part, in order to be reflected in the gain Gpoff.

The value and the gain calculated by the luminance suppression gain control section 171 will be described in detail in order. First, a calculation of the threshold th which may be necessary for the calculation of the gain for high luminance restraint, by the luminance suppression gain control section 171, will be described.

Figure 14:
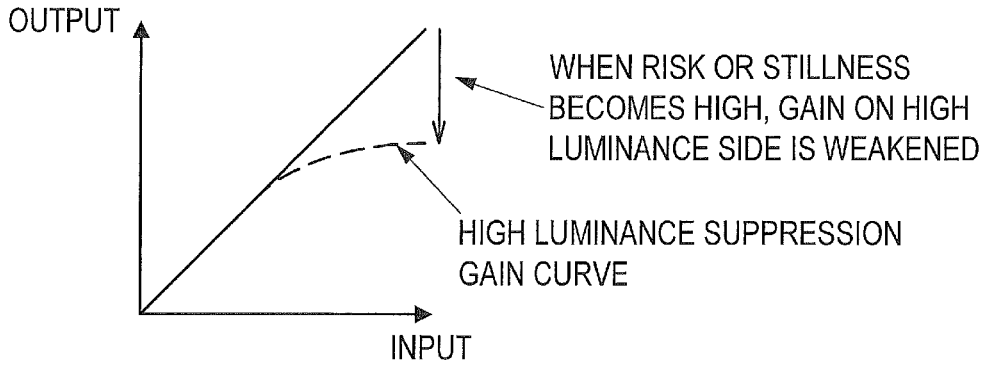
FIG. 14 is an explanatory diagram which shows a process outline of a high luminance suppression gain calculation section 179.

The threshold th is used for the calculation of a gain curve for suppressing the luminance of the high luminance side, in the high luminance suppression gain calculation section 179. FIG. 14 is an explanatory diagram which shows a process outline of the high luminance suppression gain calculation section 179. As shown in FIG. 14, calculating a gain for weakening the luminance of the high luminance side is a process by the luminance suppression gain calculation section 179, when the degree of risk or the degree of stillness increases for a video signal which has a linear characteristic.

Figure 15:
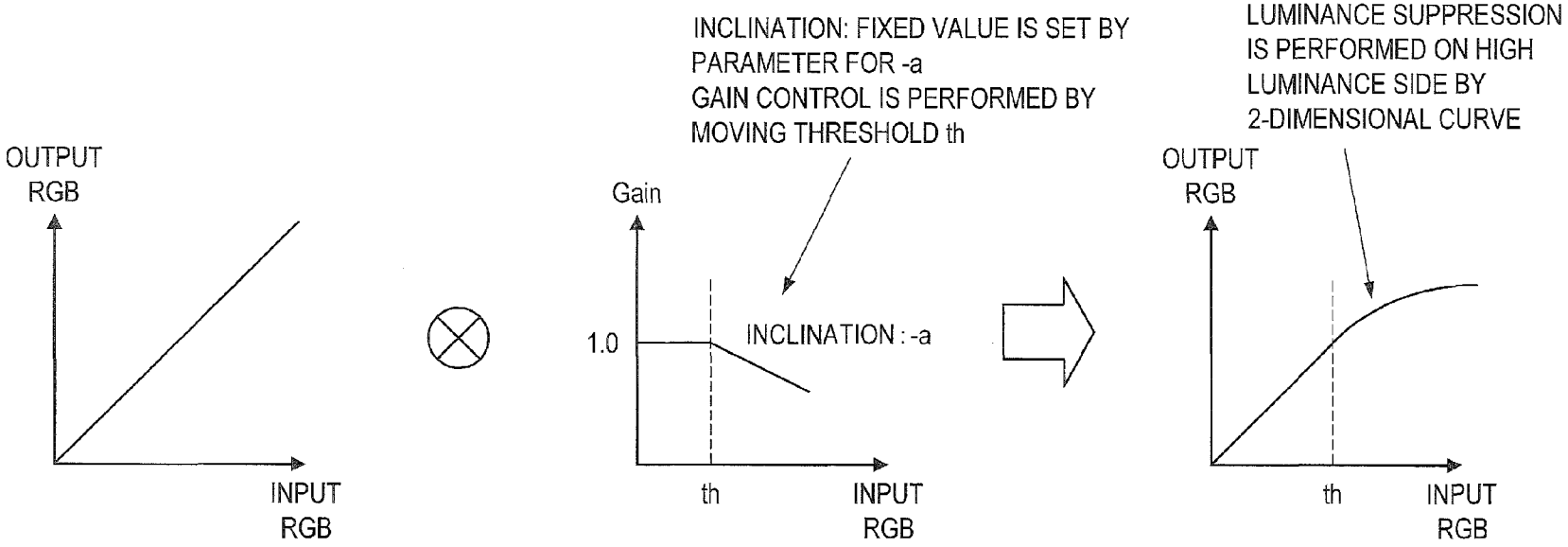
FIG. 15 is an explanatory diagram which shows a process outline of the high luminance suppression gain calculation section 179.

FIG. 15 is an explanatory diagram which shows a process outline of the high luminance suppression gain calculation section 179. As shown in FIG. 15, the luminance of the input signal has a gain of 1.0 times from 0 up to a prescribed threshold th, for a video signal which has a linear characteristic, and when such a gain is applied which decreases by an inclination −a when the threshold th is exceeded, the luminance of the high luminance side can be controlled by a two-dimensional curve. When the input is set as x and the output is set as y, the process by the high luminance suppression gain calculation section 179 is represented by the following equation.

$$y = \text{Gain} * x = \begin{cases} x \ \ldots \ (x \le th) \\ -ax^2 + (1 + a * th) * x \ \ldots \ (x > th) \end{cases}$$

The high luminance suppression gain calculation section 179 outputs a gain Gain to the multiplier 180 so as to satisfy the above described equation. The multiplier 180 multiplies the gain output from the multiplier 178, which is a is a gain for a shading process which will be described later, by the gain Gain output by the high luminance suppression gain calculation section 179, and outputs the multiplication result to the multipliers 181*a*, 181*b* and 181*c*. The multipliers 181*a*, 181*b* and 181*c* suppress the luminance of the high luminance side, by multiplying the output of the multiplier 180 for the video signal of each of R, G and B, and outputting the multiplication result.

Figure 16:
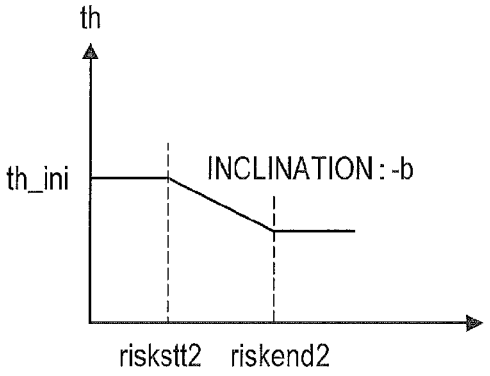
FIG. 16 is an explanatory diagram which shows a graph used when a threshold th is obtained by a luminance suppression gain control section 171.

The luminance suppression gain control section 171 is the section which obtains this threshold th. FIG. 16 is an explanatory diagram which shows a graph used when obtaining the threshold th by the luminance suppression gain control section 171. In the graph shown in FIG. 16, the horizontal axis is the maximum value for the entire screen in the risk map generated by the risk and stillness detection section 110, and the vertical axis is the threshold th.

In the case where the maximum value for the entire screen in the risk map is equal to or less than a prescribed value riskstt2, such as in the graph shown in FIG. 16, the luminance suppression gain control section 171 outputs the threshold th as a prescribed threshold th_ini. Also, when the maximum value for the entire screen in the risk map exceeds the prescribed value riskstt2, the luminance suppression gain control section 171 outputs the threshold th lowered from th_ini. The luminance suppression gain control section 171 lowers the threshold th from th_ini so that the inclination becomes −b.

Also, when the maximum value for the entire screen in the risk map becomes a prescribed value riskend2, the luminance suppression gain control section 171 stops the reduction of the threshold th, and thereafter outputs the same value even if the maximum value for the entire screen in the risk map exceeds riskend2.

The process which calculates the threshold th by the luminance suppression gain control section 171 is represented by the following equation.

```
if (riskpeak<riskstt2)th=th_ini

elseif (riskpeak<riskend2)th=th_ini−b*(riskpeak−
    riskstt2)

else th=th_ini−b*(riskend2−riskstt2)
```

Note that while a case has been mentioned in the above description which uses a risk map, the luminance suppression gain control section 171 calculates a similar threshold by using a stillness map. Also, the luminance suppression gain control section 171 compares the threshold th obtained by using the risk map with the threshold th obtained by using the stillness map, and outputs the lowest threshold to the high luminance control gain calculation section 179.

Heretofore, a calculation of the threshold th which may be necessary for the calculation of a gain for high luminance control, by the luminance suppression gain control section 171, has been described. Next, a calculation of the gain Gall for controlling the luminance of the entire screen, by the luminance suppression gain control section 171, will be described.

Figure 17:
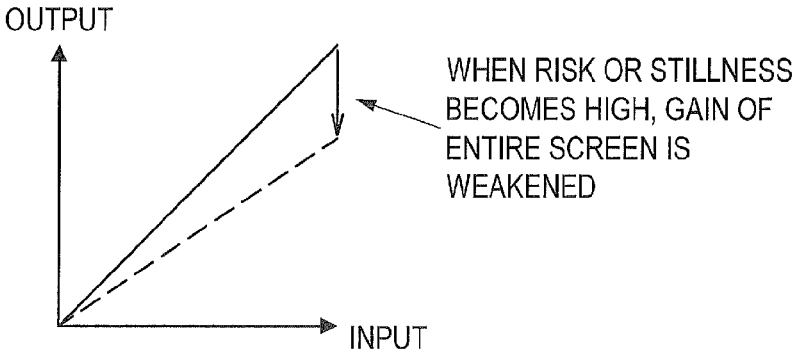
FIG. 17 is an explanatory diagram which shows an outline of luminance control by a gain Gall for controlling the luminance of the entire screen.

FIG. 17 is an explanatory diagram which shows an outline of luminance control by the gain Gall for controlling the luminance of the entire screen, which is calculated by the luminance suppression gain control section 171. As shown in FIG. 17, the luminance suppression gain control section 171 calculates the gain Gall for uniformly weakening the luminance, regardless of the input level, when the degree of risk or the degree of stillness increases, for a video signal which has a linear characteristic.

Figure 18:
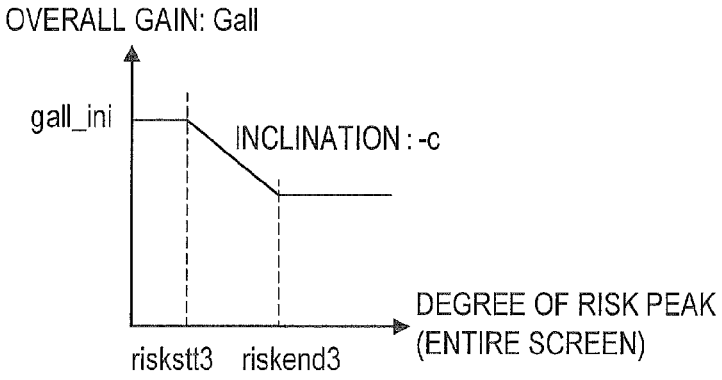
FIG. 18 is an explanatory diagram which shows a graph used when the luminance suppression gain control section 171 obtains a gain Gall.

FIG. 18 is an explanatory diagram which shows a graph used when obtaining the gain Gall by the luminance suppression gain control section 171. In the graph shown in FIG. 18, the horizontal axis is the maximum value for the entire screen in the risk map generated by the risk and stillness detection section 110, and the vertical axis is the gain Gall.

In the case where the maximum value for the entire screen in the risk map is equal to or less than a prescribed value riskstt3, such as in the graph shown in FIG. 18, the luminance suppression gain control section 171 outputs the gain Gall as a prescribed value gall_ini. Also, when the maximum value for the entire screen in the risk map exceeds the prescribed value riskstt3, the luminance suppression gain control section 171 outputs the gain Gall lowered from gall_ini. The luminance suppression gain control section 171 lowers the gain Gall from gall_ini so that the inclination becomes −c.

Also, when the maximum value for the entire screen in the risk map becomes a prescribed value riskend3, the luminance suppression gain control section 171 stops the reduction of the gain Gall, and thereafter outputs the same value even if the maximum value for the entire screen in the risk map exceeds riskend3. The process which calculates the gain Gall by the luminance suppression gain control section 171 is represented by the following equation.

if (riskpeak<riskstt3)*Gall=gall_ini* elseif (riskpeak<riskend3)*Gall=gall_ini−c**(riskpeak−riskstt3)

else *Gall=gall_ini−c**(riskend3−riskstt3)

Note that while a case has been mentioned in the above description which uses a risk map, the luminance suppression gain control section 171 calculates a similar gain by using a stillness map. Also, the luminance suppression gain control section 171 compares the gain Gall obtained by using the risk map with the gain Gall obtained by using the stillness map, and outputs the lowest threshold to the multiplier 178.

Heretofore, a calculation of the gain Gall for controlling the luminance of the entire screen, by the luminance suppression gain control section 171, has been described. Next, a calculation of the gain Ksh_base for controlling the shading ratio for a screen peripheral part, by the luminance suppression gain control section 171, will be described.

Figure 19:
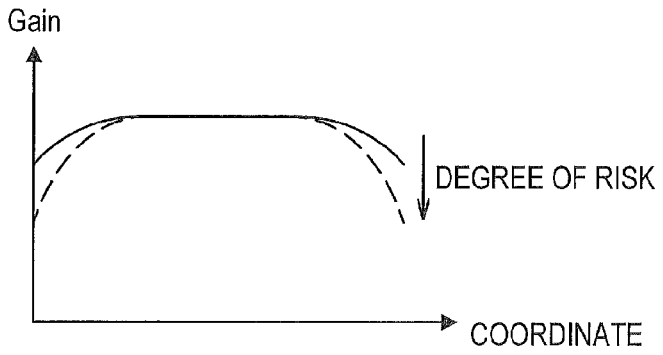
FIG. 19 is an explanatory diagram which shows an outline of luminance control by a gain Ksh_base for controlling a shading ratio for a screen peripheral part.

FIG. 19 is an explanatory diagram which shows an outline of luminance control by the gain Ksh_base for controlling the shading ratio for a screen peripheral part, which is calculated by the luminance suppression gain control section 171. In graph shown in FIG. 19, the horizontal axis shows the coordinates of the screen shown by the organic EL display panel 200, and the vertical axis shows the gain. As shown in FIG. 19, the control of the shading ratio for the screen peripheral part is a control so that the gain at the screen peripheral part becomes smaller than that at the screen central portion. Also, the gain for the screen peripheral part becomes smaller by the application of the gain Ksh_base, when the degree of risk or the degree of stillness increases. This is a control of the shading ratio for the screen peripheral part, by the gain Ksh_base calculated by the luminance suppression gain control section 171.

Note that, the luminance control for a screen peripheral part shown in FIG. 19 is performed for at least one of the vertical direction or the horizontal direction. Further, the shading ratio for the screen peripheral part may be independently set for each of the horizontal direction and the vertical direction.

Figure 20:
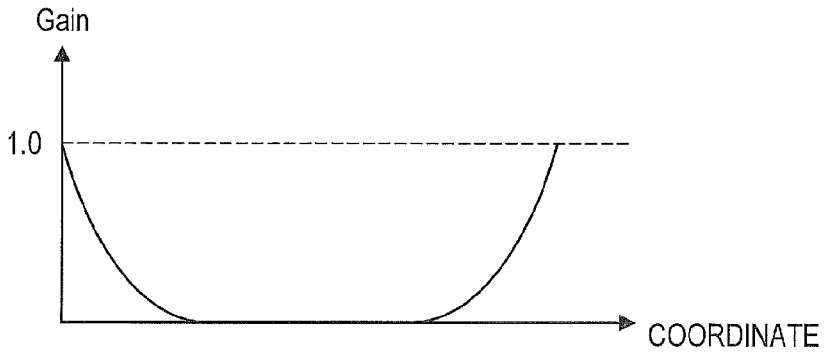
FIG. 20 is an explanatory diagram which shows an example of a shading shape stored in an original signal component shading gain LUT 173.

FIG. 20 is an explanatory diagram which shows an example of a shading shape stored in the original signal component shading gain LUT 173. The image persistence prevention control section 104 retains a gain which uses a shape such as shown in FIG. 20 in the original signal component shading gain LUT 173, and performs luminance control for the screen peripheral part by subtracting this gain from 1. The luminance control for the screen peripheral part is represented by the following equation. In the following equation, $G_{SH}$ is a gain for luminance control for the screen peripheral part, LUT is a gain stored in the original signal component shading gain LUT 173, and riskpeak_frm is the maximum value of the degree of risk for the screen peripheral part in the risk map generated by the risk and stillness detection section 110.

$$G_{SH}=1-\text{LUT}*\text{Ksh_base}(\text{riskpeak_frm})$$

Note that, since the gain Ksh_base can take a value equal to or more than 1, there are cases where $G_{SH}$ can become a negative value in the above described equation. The luminance suppression gain control section 171 performs a clipping process in which $G_{SH}$ will be 0 in the case where $G_{SH}$ becomes a negative value.

Figure 21:
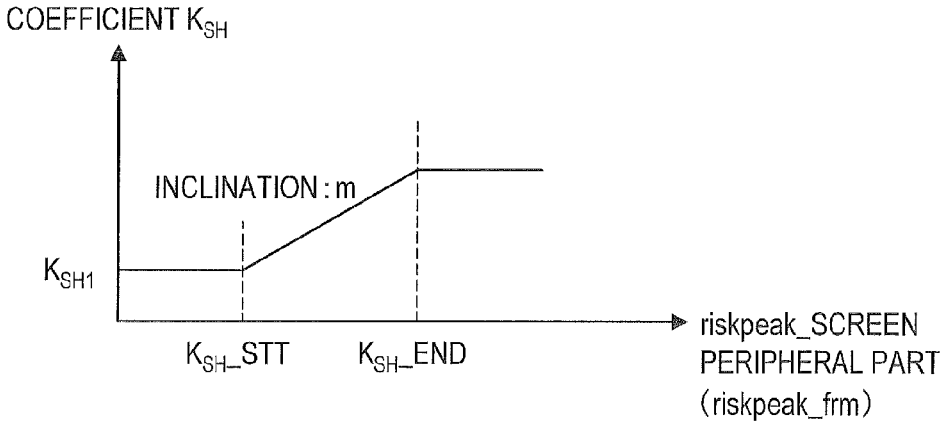
FIG. 21 is an explanatory diagram which shows a graph used when the luminance suppression gain control section 171 obtains a gain Ksh_base.

FIG. 21 is an explanatory diagram which shows a graph used when obtaining the gain Ksh_base by the luminance suppression gain control section 171. In the graph shown in FIG. 21, the horizontal axis is the maximum value of the degree of risk for the screen peripheral part in the risk map generated by the risk and stillness detection section 110, and the vertical axis is the gain Ksh_base.

In the case where the maximum value for the screen peripheral part in the risk map is equal to or less than a prescribed value Ksh_STT, such as in the graph shown in FIG. 21, the luminance suppression gain control section 171 outputs the gain Ksh_base as a prescribed value Ksh1. Also, when the maximum value for the screen peripheral part in the risk map exceeds the prescribed value Ksh_STT, the luminance suppression gain control section 171 outputs the gain Ksh_base raised from Ksh1. The luminance suppression gain control section 171 raises the gain Ksh_base from Ksh1 so that the inclination becomes +m.

Also, when the maximum value for the screen peripheral part in the risk map becomes a prescribed value Ksh_END, the luminance suppression gain control section 171 stops the rise of the gain Ksh_base, and thereafter outputs the same value even if the maximum value for the screen peripheral part in the risk map exceeds Ksh_END.

Heretofore, a calculation of the gain Ksh_base for controlling the shading ratio for a screen peripheral part, by the luminance suppression gain control section 171, has been described. Next, a calculation of the gain Gpoff for weakening the gain when performing the raising process of the luminance control section 103, by the luminance suppression gain control section 171, will be described.

Figure 22:
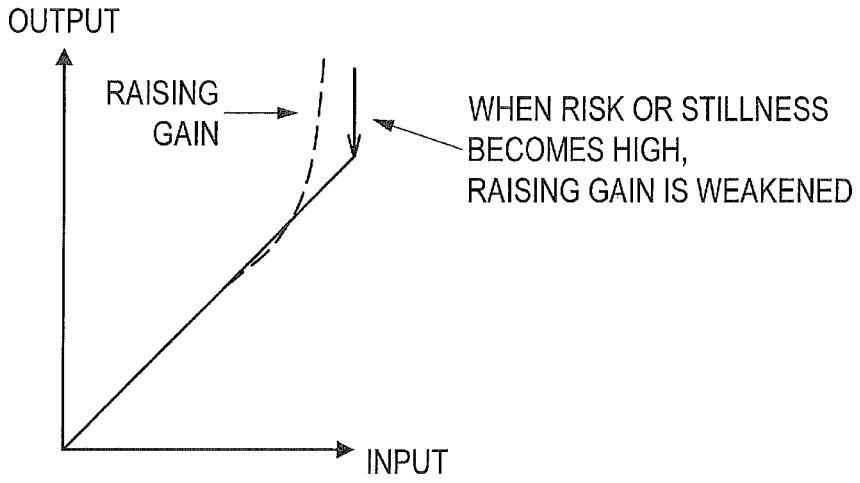
FIG. 22 is an explanatory diagram which shows, by a graph, a state in which a high luminance side of a video signal having a linear characteristic is raised to a higher luminance.

The organic EL display panel 200 according to an embodiment of the present disclosure is a display panel which displays images with the four colors R, G, B, W. In the case where a video has a high luminance, a clear image can be displayed on the organic EL display panel 200 by raising the high luminance side to a higher luminance. FIG. 22 is an explanatory diagram which shows, by a graph, a state in which a high luminance side of a video signal having a linear characteristic is raised to a higher luminance.

Here, a raising process by the luminance control section 103 will be described. An HSV/HSL conversion section 182 included in the luminance control section 103 converts a video signal supplied to the luminance control section 103 into a hue H, a saturation S, a lightness V, or a luminance L. A raising gain LUT 183 refers to the saturation S, the lightness V or the luminance L output by the HSV/HSL conversion section 182, and outputs a gain Gv/Gs for the hue component, the lightness component, or the luminance component. A large area detection section 184 detects an area of a white image within the screen in block units which have a prescribed size, for the lightness V or the luminance L output by the HSV/HSL conversion section 182, and outputs a gain Garea corresponding to the area. The multiplier 185 multiplies the gain Gv/Gs by the gain Garea and outputs the multiplication result, and the adder 186 adds 1.10 to the output of the multiplier 185, and outputs the addition result.

Further, the luminance gain calculation section 187 included in the luminance control section 103 outputs a gain Gbase by referring to a look-up table, from the average luminance value of the video signal supplied to the luminance control section 103. The gain Gbase becomes a gain Gup by multiplying by the output of the adder 186 at the multiplier 189 after passing through the IIR filter 188. The high luminance side of the video signal supplied to the luminance control section 103 is raised to a higher luminance, by having the gain Gup multiplied at the multipliers 190*a*, 190*b* and 190*c*.

However, when the high luminance side is raised to a higher luminance at a position where the degree of risk or the degree of stillness is high, an image persistence phenomenon is likely to occur at the pixels of this position. Therefore, it is desirable to lower the raising amount at the position where the degree of risk or the degree of stillness is high, such as shown in FIG. 22, or to not perform this raising. The gain Gpoff calculated by the luminance suppression gain control section 171 is used to control this raising.

Figure 23:
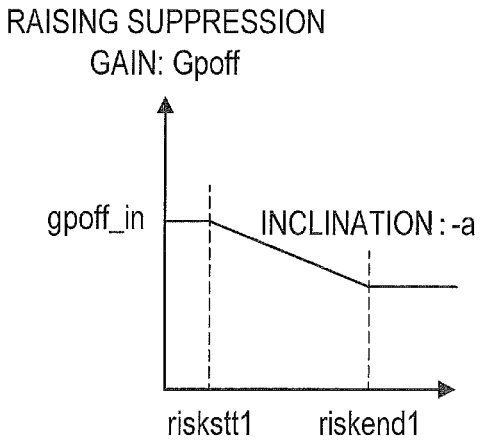
FIG. 23 is an explanatory diagram which shows a graph used when the luminance suppression gain control section 171 obtains a gain Gpoff.

FIG. 23 is an explanatory diagram which shows a graph used when obtaining the gain Gpoff by the luminance suppression gain control section 171. In the graph shown in FIG. 23, the horizontal axis is the maximum value of the degree of risk for the entire screen in the risk map generated by the risk and stillness detection section 110, and the vertical axis is the gain Gpoff.

As shown in the graph shown in FIG. 23, in the case where the maximum value of the degree of risk for the entire screen in the risk map is equal to or less than a prescribed value riskstt1, the luminance suppression gain control section 171 outputs the gain Gpoff as a prescribed value gpoff_ini. Also, when the maximum value of the degree of risk for the entire screen in the risk map exceeds the prescribed value riskstt1, the luminance suppression gain control section 171 outputs the gain Gpoff lowered from gpoff_ini. The luminance suppression gain control section 171 lowers the gain Gpoff from gpoff_ini so that the inclination becomes −a.

Also, when the maximum value of the degree of risk for the entire screen in the risk map becomes a prescribed value riskend1, the luminance suppression gain control section 171 stops the reduction of the gain Gpoff, and thereafter outputs the same value even if the maximum value of the degree of risk for the entire screen in the risk map exceeds riskend1. The process which calculates the gain Gpoff by the luminance suppression gain control section 171 is represented by the following equation.

if (riskpeak<riskstt1)*Gpoff*=*gpoff_ini* elseif (riskpeak<riskend1)*Gpoff*=*gpoff_ini*−*a**(riskpeak−riskstt1)

else *Gpoff*=*gpoff_ini*−*a**(riskend1−riskstt1)

Note that while a case has been mentioned in the above description which uses a risk map, the luminance suppression gain control section 171 calculates a similar gain by using a stillness map or a risk map for partial control. Also, the luminance suppression gain control section 171 compares, by pixel units, the gain Gpoff obtained by using the risk map, the gain Gpoff obtained by using the stillness map, and the gain Gpoff obtained by using the risk map for partial control, and outputs the lowest gain to the multiplier 177.

The luminance suppression gain control section 171 may perform a calculation so that the range of the gain Gpoff is changed from 0 times to 1 time, or may perform a calculation so that the range is changed from −1 time to 1 time. In the case where the range of the gain Gpoff is changed from 0 times to 1 time, the raising is canceled in the high luminance side of the input video signal. On the other hand, in the case where the range of the gain Gpoff is changed from −1 time to 1 time, not only is the raising canceled in the high luminance side of the input video signal, but also the luminance of the high luminance side of the input video signal is suppressed.

The gain Ksh_peak is a gain to be reflected in the gain Gpoff and for controlling the shading ratio of the screen peripheral part. By having the gain Ksh_peak multiplied together with the gain Gpoff, the luminance control section 103 can cancel the raising for the screen peripheral part being greater than that of the screen central part. The luminance suppression gain control section 171 executes a calculation of the gain Ksh_peak similar to the calculation of the above described gain Ksh_base.

Heretofore, a calculation of the gain Gpoff for weakening the gain when performing the raising process by the luminance control section 103, by the luminance suppression gain control section 171, has been described. Next, a process of the IIR filter 176 included in the image persistence prevention control section 104 will be described.

The threshold th, and the gains Gall, Gpoff, Ksh_base and Ksh_peak generated by the luminance suppression gain control section 171 are sent to the IIR filter 176. The IIR filter 176 suppresses sudden changes of the threshold th, and the gains Gall, Gpoff, Ksh_base and Ksh_peak. The degree of risk and the degree of stillness are gradually counted up in the risk and stillness detection section 110, and are rapidly cancelled in the risk and stillness detection section 110 when a different image is input once.

However, when the degree of risk and the degree of stillness are rapidly cancelled when releasing the threshold and gain control, rapid changes of luminance may occur when an image is displayed on the organic EL display panel 200. Therefore, the IIR filter 176 is a filter for gradually changing the threshold or the gain. The process of the IIR filter 176 is represented by the following equation. In the following equation, $X_n$ represents the input of the current time, $Y_n$ represents the output of the current time, $Y_{n-1}$ represents the output of a previous time, and K represents the feedback ratio.

$$K=(1-K)*X_n+K*Y_{n-1}$$

$$Y_n=X_n+K*(Y_{n-1}-X_n)$$

Figure 24:
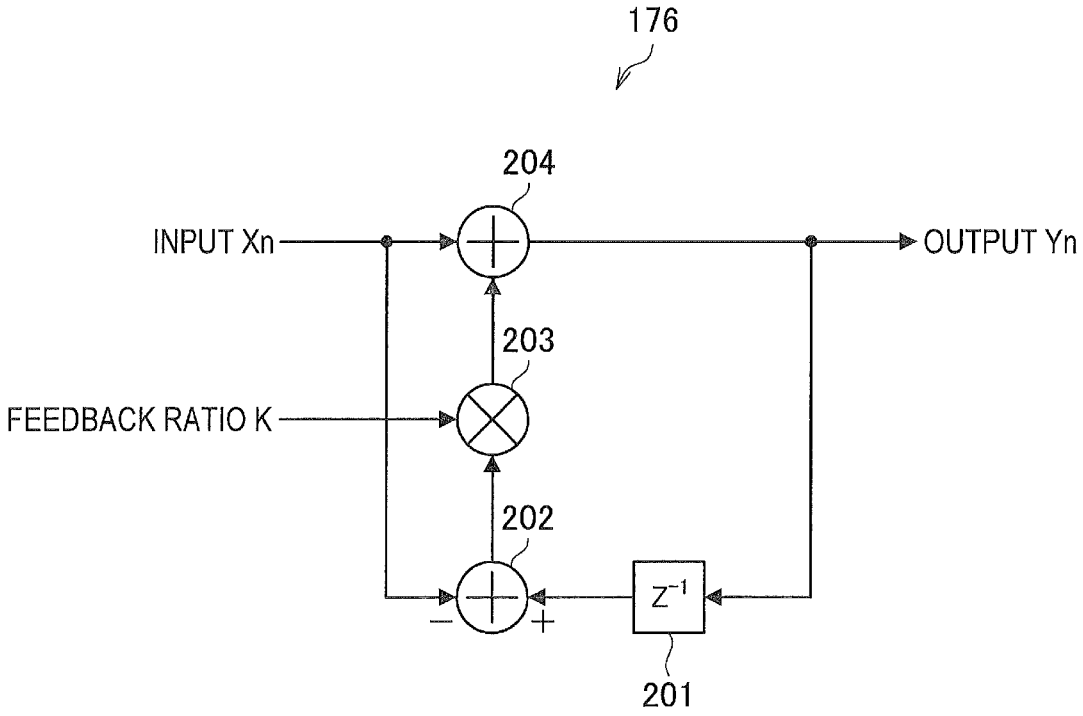
FIG. 24 is an explanatory diagram which shows a configuration example of an IIR filter 176.

FIG. 24 is an explanatory diagram which shows a configuration example of the IIR filter 176. As shown in FIG. 24, the IIR filter 176 includes a delay section 201, adders 202 and 204, and a multiplier 203.

The delay section 201 outputs an output of the adder 204 to the adder 202 delayed by one frame. The adder 202 subtracts the input of the current time $X_n$ from the output of 1 time previous $Y_{n-1}$, and outputs the subtraction result to the multiplier 203. The multiplier 203 multiplies the prescribed feedback ration K by the output of the adder 202, and outputs the multiplication result. The adder 204 adds the output of the multiplier 203 to the input of the current time $X_n$, and outputs the addition result as the output of the current time $Y_n$.

Heretofore, the process of the IIR filter 176 included in the image persistence prevention control section 104 has been described. Up to here, examples of luminance control and image persistence prevention control have been described. To continue, next, a WRGB conversion process by the WRGB conversion section 105, using the risk map for partial control generated by the risk and stillness detection section 110, will be described.

[Example of the WRGB Conversion Process Using a Risk Map for Partial Control]

As described above, the organic EL display panel 200 according to an embodiment of the present disclosure is a display panel which displays an image with the four colors R, G, B, W. Since a video signal is supplied with only the three colors R, G, B, it may be necessary to generate a signal, from this video signal, in order to supply W pixels. The WRGB conversion section 105 is a section for executing a WRGB conversion process which generates a signal from the video signal of the three colors R, G, B in order to supply W pixels.

For example, in the case where the input video signal is a video signal which displays a white image, when the video signal is converted so that only W pixels emit light, the power consumption can be suppressed since the pixels of the other colors are not emitting light. However, when only the W pixels emit light, deterioration of the W pixels will be intense when compared to that of the pixels of other colors. Therefore, in the case where the input video signal is a video signal which displays a white image, by executing a WRGB conversion process for the video signal so that the pixels of other colors are also used, the WRGB conversion section 105 can suppress the deterioration of the W pixels. The conversion process by the WRGB conversion section 105 is expressed by the following equation.

$$\begin{pmatrix} Rout \\ Gout \\ Bout \end{pmatrix} = \begin{pmatrix} Rin \\ Gin \\ Bin \end{pmatrix} - Wout * \begin{pmatrix} Kr \\ Kg \\ Kb \end{pmatrix}$$

$$Wout = Gw * \mathrm{MIN}\left(\frac{Rin}{Kr}, \frac{Gin}{Kg}, \frac{Bin}{Kb}\right)$$

$R_{in}$, $G_{in}$ and $B_{in}$ represent the signal levels of each of the colors R, G, B input to the WRGB conversion section 105, and $R_{out}$, $G_{out}$, $B_{out}$ and $W_{out}$ represent the signal levels of each of the colors R, G, B, W output from the WRGB conversion section 105. Further, $K_r$, $K_g$ and $K_b$ are coefficients by each of the colors R, G, B which contribute to the white color signal, and Gw is a gain (W conversion coefficient) provided to the white color signal. $K_r$, $K_g$ and $K_b$ can be obtained by the following matrix equation. X, Y and Z are tri-stimulus values. Note that, it is desirable that the inverse matrix on the right side of the following equation is used for the calculation of $K_r$, $K_g$ and $K_b$ in a calculation performed in advance.

$$\begin{pmatrix} K_r \\ K_g \\ K_b \end{pmatrix} = \begin{pmatrix} X_{WR} & X_{WG} & X_{WB} \\ Y_{WR} & Y_{WG} & Y_{WB} \\ Z_{WR} & Z_{WG} & Z_{WB} \end{pmatrix}^{-1} \begin{pmatrix} X_W \\ Y_W \\ Z_W \end{pmatrix}$$

In the present embodiment, the WRGB conversion section 105 controls the value of the gain Gw, by using the risk map for partial control generated by the risk and stillness detection section 110. By using the risk map for partial control, the WRGB conversion section 105 can lower the value of the gain Gw for locations at which the degree of risk is high.

Figure 25:
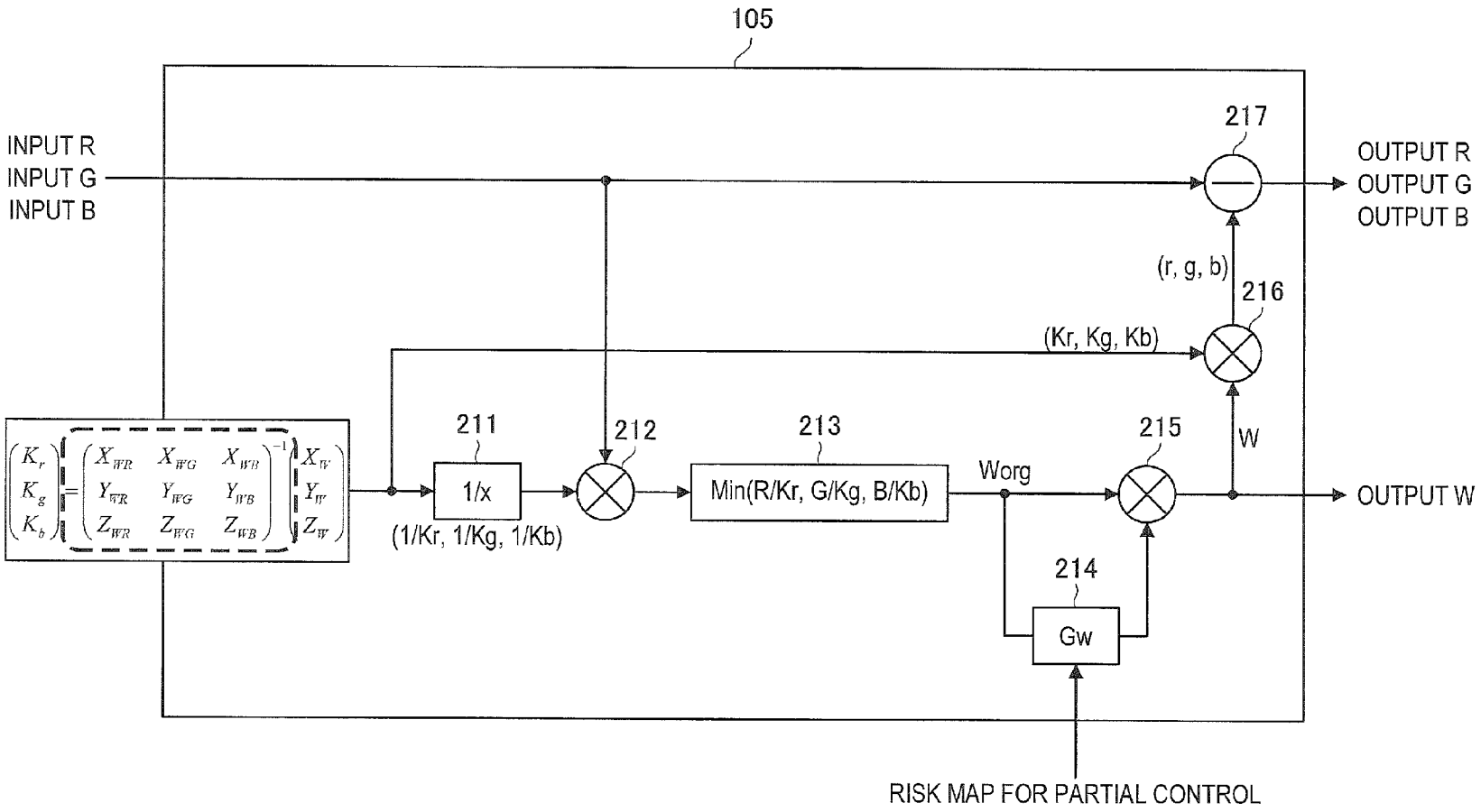
FIG. 25 is an explanatory diagram which shows a configuration example of a WRGB conversion section 105 according to an embodiment of the present disclosure.

FIG. 25 is an explanatory diagram which shows a configuration example of the WRGB conversion section 105 according to an embodiment of the present disclosure. As shown in FIG. 25, the WRGB conversion section 105 according to an embodiment of the present disclosure includes a reciprocal calculation section 211, multipliers 212, 215 and 216, a minimum value selection section 213, a gain calculation section 214, and a subtractor 217.

The reciprocal calculation section 211 calculates a reciprocal of the coefficients $K_r$, $K_g$ and $K_b$, and outputs the calculation result to the multiplier 212. The multiplier 212 multiplies the input level of each of the colors R, G, B by the reciprocal of the coefficients $K_r$, $K_g$ and $K_b$, and outputs the multiplication result to the minimum value selection section 213. The minimum value selection section 213 selects a minimum value Worg from among the output values from the multiplier 212, and outputs this minimum value to the gain calculation section 214 and the multiplier 215.

The gain calculation section 214 performs a calculation of the gain Gw by using the output Worg of the minimum value selection section 213, and outputs the calculated gain Gw to the multiplier 215. Further, the gain calculation section 214 controls the value of the output gain Gw, by using the risk map for partial control generated by the risk and stillness detection section 110. The multiplier 215 sets, as an output of W, the result of the gain calculation section 214 multiplying the gain Gw by the output of the minimum value selection section 213, and outputs this output of W to the multiplier 216.

The multiplier 216 multiplies the output of the multiplier 215 by each of the coefficients $K_r$, $K_g$ and $K_b$, and outputs the multiplication result. The subtractor 217 subtracts each of the outputs of the multiplier 216 from the input level of each of the colors R, G, B, and outputs the subtraction result. By having a configuration such as shown in FIG. 25, the WRGB conversion section 105 according to an embodiment of the present disclosure can convert an input video signal of RGB into a video signal of RGBW, and can output the converted video signal.

Figure 26:
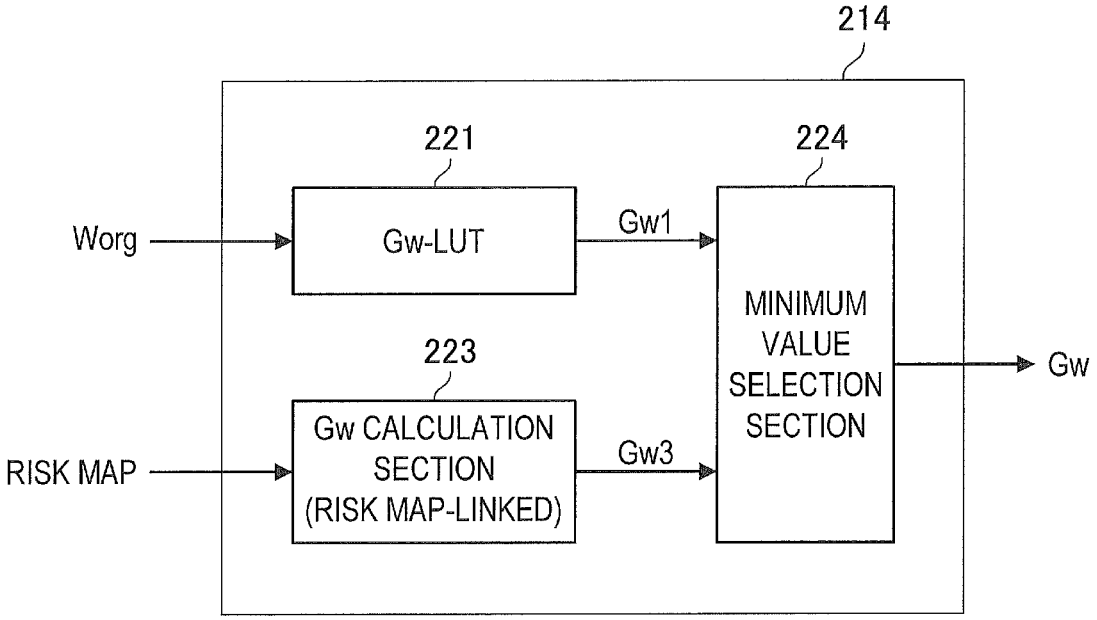
FIG. 26 is an explanatory diagram which shows a configuration example of a gain calculation section 214.

To continue, a configuration example of the gain calculation section 214 included in the WRGB conversion section 105 according to an embodiment of the present disclosure will be described. FIG. 26 is an explanatory diagram which shows a configuration example of the gain calculation section 214. Hereinafter, a configuration example of the gain calculation section 214 will be described by using FIG. 26.

As shown in FIG. 26, the gain calculation section 214 included in the WRGB conversion section 105 according to an embodiment of the present disclosure includes a gradation-dependent gain calculation section 221, a risk-linked gain calculation section 223, and a minimum value selection section 224.

Figure 27:
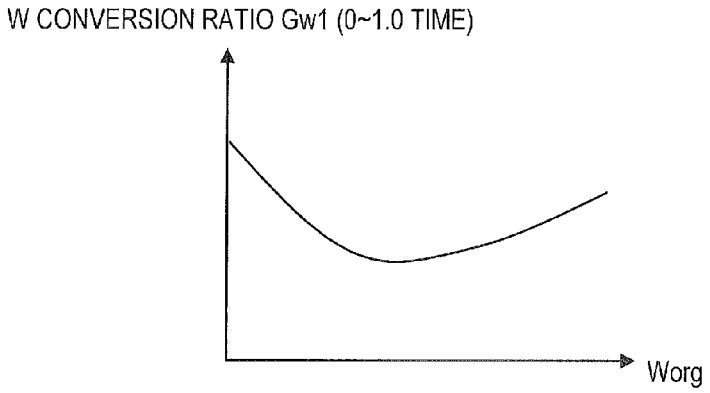
FIG. 27 is an explanatory diagram which shows an example of a look-up table referred to by a gradation-dependent gain calculation section 221.

The gradation-dependent gain calculation section 221 outputs a gain Gw1 by referring to a look-up table retained within, or external to, the gradation-dependent gain calculation section 221, by using the output Worg of the minimum value selection section 213. FIG. 27 is an explanatory diagram which shows an example of a look-up table referred to by the gradation-dependent gain calculation section 221. FIG. 27 shows, by a graph, a look-up table referred to by the gradation-dependent gain calculation section 221. In the graph shown in FIG. 27, the horizontal axis is the output Worg of the minimum value selection section 213, and the vertical axis is the output gain Gw1 which can take values from 0 times up to 1.0 time.

Figure 28:
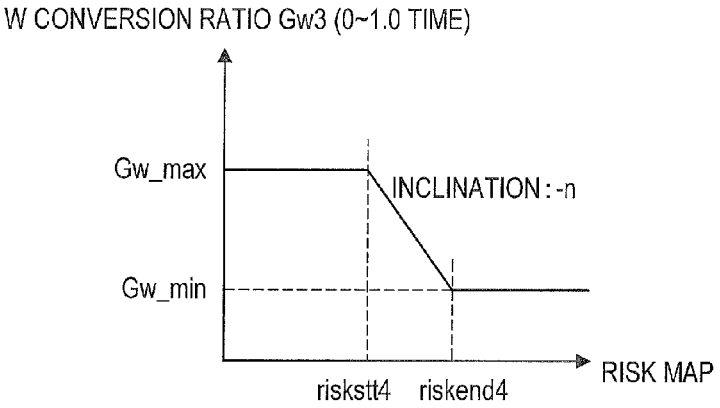
FIG. 28 is an explanatory diagram which shows a graph used when a risk-linked gain calculation section 223 obtains a gain Gw3.

The risk-linked gain calculation section 223 calculates and outputs a gain Gw3 by using the risk map for partial control generated by the risk and stillness detection section 110. FIG. 28 is an explanatory diagram which shows a graph used when obtaining the gain Gw3 by the risk-linked gain calculation section 223. In the graph shown in FIG. 28, the horizontal axis is the maximum value of the degree of risk in the risk map for partial control generated by the risk and stillness detection section 110, and the vertical axis is the gain Gw3.

In the case where the maximum value of the degree of risk in the risk map for partial control is equal to or less than a prescribed value riskstt4, such as in the graph shown in FIG. 28, the risk-linked gain calculation section 223 outputs the gain Gw3 as a prescribed value Gw_max. Also, when the maximum value of the degree of risk in the risk map for partial control exceeds the prescribed value riskstt4, the risk-linked gain calculation section 223 outputs the gain Gw3 lowered from Gw_max. The risk-linked gain calculation section 223 lowers the gain Gw3 from Gw_max so that the inclination becomes −n.

Also, when the maximum value of the degree of risk in the risk map for partial control becomes a prescribed value riskend4, the risk-linked gain calculation section 223 stops the reduction of the gain Gw3, and thereafter outputs the same value even if the maximum value of the degree of risk in the risk map for partial control exceeds riskend4.

The minimum value selection section 224 selects the minimum value from among the gain Gw1 output by the gradation-dependent gain calculation section 221 and the gain Gw3 output by the risk-linked gain calculation section 223, and outputs this minimum value as the gain Gw.

By having a configuration such as shown in FIG. 26, it becomes possible for the gain calculation section 214 included in the WRGB conversion section 105 according to an embodiment of the present disclosure to perform a calculation process of the gain Gw using the risk map for partial control. By calculating the gain Gw by using the risk map for partial control, the gain calculation section 214 can reduce the gain Gw for regions at which the degree of risk is high.

Note that while the gradation-dependent gain calculation section 221 has been described when the gain Gw1 is output by referring to the look-up table shown in FIG. 27, the gain Gw1 may be output by referring to another look-up table in addition to the look-up table shown in FIG. 27.

In the case where secular variations or temperature variations of chromaticity at a low gradation side are predominant in the W pixels, it becomes possible for the WRGB conversion section 105 to perform display in a state in which the variations of chromaticity are suppressed, by expressing white with the pixels of the three colors RGB in the case of a low gradation. Here, a low gradation is a gradation corresponding to 10nit, for example.

The chromatic variations of the W pixels depend on the current density. When current deterioration of each pixel is disregarded, the chromatic variations of the W pixels depend on the gradation of a linear space. Accordingly, by limiting a conversion coefficient at a low gradation side, it becomes possible for the WRGB conversion section 105 to perform display in a state in which the variations of chromaticity are suppressed.

Figure 29:
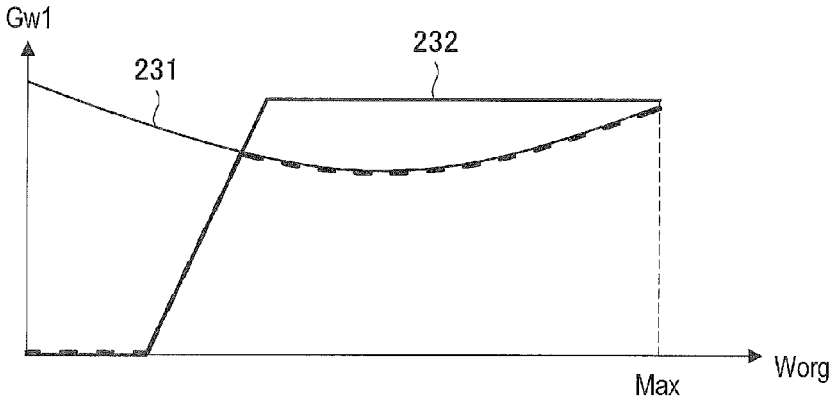
FIG. 29 is an explanatory diagram which shows an example of a look-up table referred to by the gradation-dependent gain calculation section 221.

FIG. 29 is an explanatory diagram which shows an example of a look-up table referred to by the gradation-dependent gain calculation section 221. A look-up table for limiting a conversion coefficient at a low gradation side is shown in FIG. 29 in addition to the look-up table represented by the graph shown in FIG. 27. The reference numeral 231 is the above described look-up table represented by the graph shown in FIG. 27, and the reference numeral 232 is a look-up table for suppressing chromatic variations at a low luminance side. The gradation-dependent gain calculation section 221 refers to the two look-up tables by using the input Worg, selects the smallest value of the values represented by the dotted line in FIG. 29, and outputs this smallest value as the gain Gw1.

Heretofore, a calculation process of the gain Gw using the risk map for partial control has been described. By calculating such a gain Gw, the WRGB conversion section 105 according to an embodiment of the present disclosure can reduce the value of the gain Gw for locations at which the degree of risk is high.

<2. Conclusion>

When a video signal is supplied so that the same pixels of the organic EL display panel 200 continue to emit light at a high luminance, when displaying a video on the organic EL display panel 200, the self-luminous display device 10 according to an embodiment of the present disclosure such as described above lowers the luminance for this video signal at the time when light is emitted by the organic EL display panel 200, and generates a risk map or a stillness map which is information for preventing the generation of an image persistence phenomenon.

The self-luminous display device 10 according to an embodiment of the present disclosure calculates a gain for reducing luminance, for the entire screen or for a portion of the screen, by using the risk map or the stillness map generated for preventing the generation of an image persistence phenomenon, and applies this gain to the video signal.

By calculating a risk map or a stillness map such as described above, and by performing a calculation of a gain using this risk map or this stillness map, the self-luminous display device 10 according to an embodiment of the present disclosure can execute appropriate luminance control in the case where some video signal is supplied in which there is a concern of an image persistence phenomenon occurring, and can prevent the generation of an image persistence phenomenon.

Further, the self-luminous display device 10 according to an embodiment of the present disclosure can generate a risk map for partial control in order to execute luminance control for a portion of the screen, such as described above. By generating a risk map for partial control, the self-luminous display device 10 according to an embodiment of the present disclosure can lower the luminance for regions in which there is the possibility of an image persistence phenomenon occurring, and can display a video on the organic EL display panel 200 in which there is no sense of discomfort on the entire screen.

Note that in the case where the self-luminous display device 10 according to an embodiment of the present disclosure displays a video with only the pixels of the three colors RGB, the WRGB conversion section 105 may not be included in the display control section 100.

Further, a computer program for causing hardware, such as a CPU, ROM and RAM built-into each apparatus, to exhibit functions similar to the configurations of each of the above described apparatuses can be created. Further, a storage medium storing this computer program can also be provided. Further, a series of processes can be executed with the hardware, by configuring each of the functional blocks shown by the functional block figures with the hardware.

It should be understood by those skilled in the art that various modifications, combinations, sub-combinations and alterations may occur depending on design requirements and other factors insofar as they are within the scope of the appended claims or the equivalents thereof.

For example, the luminance control section 103 and the image persistence prevention control section 104 may automatically switch a control for the video signal, in accordance with the type of information displayed on the organic EL display panel 200. For example, in the case where a data broadcast including text, images or the like is displayed on a part of the organic EL display panel 200, the image persistence prevention control section 104 may execute a control so as to change the gain applied at the portion on which the video is displayed and at the portion on which the data broadcast is displayed.

Further, for example, the luminance control section 103 and the image persistence prevention control section 104 may perform luminance control by using a peak of the degree of risk for the entire screen, by the above description, or may perform similar luminance control by using a peak of the degree of risk for a portion of the screen. For example, the process in the luminance control section 103 which cancels a gain for raising a high luminance side may not only use a peak of the degree of risk for the entire screen, but may also use a peak of the degree of risk for a portion of the screen.

Additionally, the present technology may also be configured as below.

(1) A self-luminous display device including:

a data calculation section configured to calculate, by using a supplied video signal, data relating to a luminance amount accumulated in a unit of a first block in a target region for luminance control in a screen on which a plurality of pixels are arranged in a matrix, each of the pixels including a light emitting element which emits light by itself in accordance with a current amount;

a resampling section configured to resample the data relating to the luminance amount in the target region, in a unit of a second block, the data relating to the luminance amount being calculated by the data calculation section, the second block being larger than the first block; and a scaling section configured to generate data for luminance control in the target region by scaling the data resampled by the resampling section in the unit of first block.

(2) The self-luminous display device according to (1), wherein the resampling section searches for a maximum value in a given second block and a second block surrounding the given second block, at the time when resampling the data relating to the luminance amount.

(3) The self-luminous display device according to (1) or (2), further including:

a video signal control section configured to generate a gain for the target region by using the data for luminance control generated by the scaling section, the gain canceling a gain applied to a high luminance side of the video signal.

(4) The self-luminous display device according to any one of (1) to (3), further including:

a video signal control section configured to generate a gain for the target region by using the data for luminance control generated by the scaling section, the gain lowering a luminance of a high luminance side of the video signal.

(5) The self-luminous display device according to any one of (1) to (4), further including:

a video signal control section configured to control a conversion ratio for the target region when generating a video signal to be supplied to a white pixel from video signals of red, green and blue by using the data for luminance control generated by the scaling section.

(6) The self-luminous display device according to any one of (1) to (5), further including:

a video signal control section configured to generate a gain applied to the video signal by using data relating to the luminance amount calculated for a partial region of the screen by the data calculation section.

(7) The self-luminous display device according to any one of (1) to (6), further including:

a maximum value detection section configured to detect a maximum value of the data relating to the luminance amount at only a prescribed region of a periphery of the screen for the data relating to the luminance amount generated by the data calculation section.

(8) The self-luminous display device according to (7), further including:

a video signal control section configured to control a gain applied to the prescribed region by using information of the maximum value detected at the prescribed region of the periphery of the screen by the maximum value detection section.

(9) The self-luminous display device according to any one of (1) to (8), further including:

a luminance determination section configured to cause the data calculation section to calculate the data relating to the luminance amount in a case where the video signal is equal to or more than a prescribed luminance, wherein the luminance determination section judges whether or not a maximum value of a luminance of a white color generated from video signals of red, green and blue, and a maximum value of a luminance of a monochromic color, are equal to or more than a prescribed luminance

(10) A self-luminous display device including:

a data calculation section configured to calculate data relating to a luminance amount accumulated in a unit of a first block in a target region for luminance control in a screen on which a plurality of pixels are arranged in a matrix and an image is displayed with a red pixel, a green pixel, a blue pixel, and a white pixel, each of the pixels including a light emitting element which emits light by itself in accordance with a current amount; and a signal processing section configured to execute signal processing on a video signal supplied to the screen based on a peak of the data relating to the luminance amount calculated by the data calculation section.

(11) The self-luminous display device according to (10), wherein the signal processing section executes signal processing to generate a gain for the target region by using the data relating to the luminance amount calculated by the data calculation section, the gain canceling a gain applied to a high luminance side of the video signal.

(12) The self-luminous display device according to (10) or (11), wherein the signal processing section executes signal processing to generate a gain for the target region by using the data relating to the luminance amount calculated by the data calculation section, the gain lowering a luminance of a high luminance side of the video signal.

(13) The self-luminous display device according to any one of (10) to (12), wherein the signal processing section executes signal processing to control a conversion ratio for the target region when generating a video signal to be supplied the white pixel from video signals of red, green and blue by using the data relating to the luminance amount calculated by the data calculation section.

(14) The self-luminous display device according to any one of (10) to (13), wherein the signal processing section executes signal processing on the video signal by using data for luminance control on a portion of the screen which is generated from the data relating to the luminance amount in the target region, the data relating to the luminance amount being calculated by the data calculation section.

(15) The self-luminous display device according to any one of (10) to (14), wherein the signal processing section executes signal processing to generate a gain for the target region by using the data relating to the luminance amount calculated by the data calculation section, the gain uniformly controlling a luminance of a whole of the screen.

(16) The self-luminous display device according to (10), wherein the signal processing section executes signal processing on the video signal supplied to the screen based on a peak of the data relating to the luminance amount detected at only a prescribed region of a periphery of the screen.

(17) The self-luminous display device according to (16), wherein the signal processing section executes signal processing to control a gain applied to the prescribed region.

(18) The self-luminous display device according to (16) or (17), wherein the signal processing section executes signal processing to generate a gain for the target region by using the data relating to the luminance amount calculated by the data calculation section, the gain canceling a gain applied to a high luminance side of the video signal.

(19) The self-luminous display device according to any one of (16) to (18), wherein the signal processing section executes signal processing to generate a gain for the target region by using the data relating to the luminance amount calculated by the data calculation section, the gain lowering a luminance of a high luminance side of the video signal.

(20) The self-luminous display device according to any one of (16) to (19), wherein the signal processing section executes signal processing to generate a gain for the target region by using the data relating to the luminance amount calculated by the data calculation section, the gain uniformly controlling a luminance of a whole of the target region.

(21) A method for controlling a self-luminous display device, the method including:

calculating, by using a supplied video signal, data relating to a luminance amount accumulated in a unit of a first block in a target region for luminance control in a screen on which a plurality of pixels are arranged in a matrix, each of the pixels including a light emitting element which emits light by itself in accordance with a current amount;

resampling the data relating to the luminance amount in the target region, in a unit of a second block, the data relating to the luminance amount being calculated in the data calculation step, the second block being larger than the first block; and generating data for luminance control in the target region by scaling the data resampled in the resampling step in the unit of first block.

(22) A method for controlling a self-luminous display device, the method including:

calculating data relating to a luminance amount accumulated in a unit of a first block in a target region for luminance control in a screen on which a plurality of pixels are arranged in a matrix and an image is displayed with a red pixel, a green pixel, a blue pixel, and a white pixel, each of the pixels including a light emitting element which emits light by itself in accordance with a current amount; and executing signal processing on a video signal supplied to the screen based on a peak of the data relating to the luminance amount calculated in the data calculation step.

What is claimed is:

1. A display device comprising:

a screen on which a plurality of pixels are arranged in a matrix, each pixel of the plurality of pixels including a light emitting element which emits light in accordance with a current amount; and a display controller that generates a luminance map, wherein the display controller is configured to:

generate, based on luminance data from a video signal, data relating to a luminance amount accumulated in a unit of a first block in a target region for luminance control in the screen on which the plurality of pixels are arranged, sample the data relating to the luminance amount in the target region in a unit of a second block, wherein the second block is larger than the first block, and generate data for luminance control in the target region by scaling the data sampled in the unit of the first block.

2. The display device according to claim 1, wherein the display controller is configured to search for a maximum value in the second block and a block surrounding the second block.

3. The display device according to claim 1, wherein the display controller is configured to generate a gain for the target region by using the data for luminance control, wherein the generated gain cancels a gain applied to a high luminance side of the video signal.

4. The display device according to claim 1, wherein the display controller is configured to generate a gain for the target region by using the data for luminance control, wherein the generated gain reduces a luminance of a high luminance side of the video signal.

5. The display device according to claim 1, wherein the display controller is configured to control a conversion ratio for the target region when generating a video signal to be supplied to a white pixel from video signals of red, green and blue by using the data for luminance control.

6. The display device according to claim 1, wherein the display controller is configured to generate a gain applied to the video signal by using data relating to the luminance amount calculated for a partial region of the screen.

7. The display device according to claim 1, wherein the display controller is configured to detect a maximum value of the data relating to the luminance amount at only a prescribed region of a periphery of the screen for the data relating to the luminance amount.

8. The display device according to claim 7, wherein the display controller is configured to generate a gain applied to the prescribed region by using information of the maximum value detected at the prescribed region of the periphery of the screen.

9. The display device according to claim 1 wherein the display controller is configured to generate the data relating to the luminance amount in a case where the video signal is equal to or more than a prescribed luminance, and determine whether or not a maximum value of a luminance of a white color generated from video signals of red, green and blue, and a maximum value of a luminance of a monochromic color, are equal to or more than a prescribed luminance.

10. A display device comprising:

a screen on which a plurality of pixels are arranged in a matrix, each pixel of the plurality of pixels including a light emitting element which emits light in accordance with a current amount; and a display controller that generates a luminance map, wherein the display controller is configured to:

generate data relating to a luminance amount accumulated in a unit of a first block in a target region for luminance control in the screen on which a plurality of pixels are arranged in a matrix and an image is displayed with a red pixel, a green pixel, a blue pixel, and a white pixel, and process a video signal supplied to the screen based on a peak of the data relating to the luminance amount, and generate a gain for the target region by using the data relating to the luminance amount, wherein the generated gain cancels a gain applied to a high luminance side of the video signal.

11. The display device according to claim 10, wherein the display controller is configured to control a conversion ratio for the target region when generating a video signal to be supplied to a white pixel from video signals of red, green and blue by using the data relating to the luminance amount.

12. The display device according to claim 10, wherein the display controller is configured to use data for luminance control on a portion of the screen which is generated from the data relating to the luminance amount in the target region.

13. The display device according to claim 10, wherein the display controller is configured to generate a second gain for the target region by using the data relating to the luminance amount, wherein the second gain uniformly controls a luminance of a whole of the screen.

14. The display device according to claim 10, wherein the display controller is configured to utilize a peak of the data relating to the luminance amount detected at only a prescribed region of a periphery of the screen.

15. The display device according to claim 14, wherein the display controller is configured to control a second gain applied to the prescribed region.

16. The display device according to claim 15, wherein the display controller is configured to generate a second gain for the target region by using the data relating to the luminance amount, wherein the gain uniformly controls a luminance of a whole of the target region.

17. A display device comprising:

a display panel; and a display controller, wherein the display controller is configured to:

generate, based on luminance data from a video signal, data relating to a luminance amount accumulated in a unit of a first block in a target region for luminance control in the display panel on which a plurality of pixels are arranged in a matrix, each pixel of the plurality of pixels including a light emitting element which emits light in accordance with a current amount, sample the data relating to the luminance amount in the target region in a unit of a second block, wherein the second block is larger than the first block, generate data for luminance control in the target region by scaling the sampled data in the unit of the first block, and modify luminance data of the video signal based on the scaled data.

18. The display device according to claim 17, wherein the display controller is configured to search for a maximum value in the second block and a block surrounding the second block.

19. The display device according to claim 17, wherein the display controller is configured to generate a gain for the target region by using the data for luminance control, wherein the generated gain cancels a gain applied to a high luminance side of the video signal.

20. The display device according to claim 17, wherein the display controller is configured to generate a gain for the target region by using the data for luminance control, wherein the generated gain reduces a luminance of a high luminance side of the video signal.

* * * * *